US010980377B1

(12) United States Patent
Falk et al.

(10) Patent No.: US 10,980,377 B1
(45) Date of Patent: Apr. 20, 2021

(54) APPARATUS AND METHODS FOR PAPER DISPENSING

(71) Applicant: Essity Hygiene and Health Aktiebolag, Gothenburg (SE)

(72) Inventors: Magnus Falk, Gothenburg (SE); John P. Devlin, Tewksbury, MA (US); Peter McNulty, Seattle, WA (US); Jeffrey Mekler, San Francisco, CA (US); Nathan Rollins, Boylston, MA (US)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 0 days.

(21) Appl. No.: 16/719,087

(22) Filed: Dec. 18, 2019

(51) Int. Cl.
*A47K 10/42* (2006.01)
*A47K 10/32* (2006.01)

(52) U.S. Cl.
CPC .... *A47K 10/422* (2013.01); *A47K 2010/3233* (2013.01)

(58) Field of Classification Search
CPC ..... A47K 10/427; A47K 10/422; A47K 2010/3246; A47K 10/42; A47K 10/24; A47K 2010/3233; B65D 83/0817; B65D 83/08
USPC ..... 221/45, 59, 46
See application file for complete search history.

(56) References Cited

U.S. PATENT DOCUMENTS 340,355 A 4/1886 Ramser
744,047 A 11/1903 Casterline et al.
777,082 A 12/1904 Cutler
1,111,962 A 9/1914 Hooper
1,114,354 A 10/1914 Hildebrand
1,151,064 A 8/1915 Swift
1,163,737 A 12/1915 Calvert
1,257,413 A 2/1918 Hill
(Continued)

FOREIGN PATENT DOCUMENTS

CN 1168089 A 12/1997
CN 1257413 A 6/2000
(Continued)

OTHER PUBLICATIONS

Janet Beighle-French, New Products Ease Home Frustrations, Nov. 11, 1996, The Plain Dealer, Cleveland, Ohio, p. 7.D.
(Continued)

*Primary Examiner* — Rakesh Kumar
(74) *Attorney, Agent, or Firm* — Wood Herron & Evans LLP

(57) ABSTRACT

A method for loading a stack of interfolded paper units into a dispenser includes inserting a stack of interfolded paper units into an interior volume of the dispenser through a dispenser opening. The dispenser has a lid having a dispensing aperture, as well as a movable platen that has a paper-engaging surface, and which is urged upwardly toward the dispenser opening. A bottom wall of the dispenser is disposed opposite the dispenser opening, and a lock of the dispenser is selectively engageable with the platen. The stack is placed on the platen and a downward force is exerted on the top surface of the stack to thereby push the platen downward until the platen has been engaged by the lock and has reached a locked position in which the paper-engaging surface has an oblique orientation relative to the bottom wall of the dispenser.

13 Claims, 15 Drawing Sheets

(56) References Cited

U.S. PATENT DOCUMENTS 1,333,045 A 3/1920 Swift
1,362,449 A * 12/1920 Teall ..... A47K 10/422 221/45
1,503,241 A 7/1924 Horwitt
1,508,020 A 9/1924 Horwitt
1,513,792 A 11/1924 Arelt
1,563,078 A 11/1925 Erdos
1,703,594 A 2/1929 Pratt
1,752,885 A 4/1930 Carroll
1,784,836 A 12/1930 Hess
1,893,725 A 1/1933 Boomershine
1,898,983 A 2/1933 Wheeler, Jr.
1,901,243 A 3/1933 Horwitt
1,993,885 A * 3/1935 Horwitt ..... A47K 10/427 221/55
2,081,564 A 5/1937 Tuszynski
2,092,166 A 9/1937 Kettles, Jr.
2,253,742 A * 8/1941 West ..... A47K 10/422 221/52
2,337,065 A 12/1943 Price
2,354,058 A 7/1944 Ridgeway
2,426,136 A * 8/1947 Agamaite, Jr. ..... A47K 10/427 221/57
2,491,615 A 12/1949 Laid
2,689,059 A * 9/1954 Nudell ..... A47K 10/421 220/315
2,765,909 A * 10/1956 Graham ..... A47K 10/185 206/494
2,772,021 A 11/1956 Kettles
2,849,153 A * 8/1958 Tuttle ..... A47K 10/422 221/57
2,876,884 A 3/1959 Hastie
2,932,426 A 4/1960 Hope et al.
3,028,047 A 4/1962 Tuft
3,117,694 A 1/1964 Gothreau
3,119,516 A * 1/1964 Donovan ..... B65D 83/0805 221/47
3,121,510 A * 2/1964 Holzwarth ..... A47K 10/422 221/60
3,208,634 A 9/1965 Saxe
3,214,227 A 10/1965 Edwin
3,291,339 A 12/1966 Hein
3,425,595 A * 2/1969 Shapira ..... B65D 83/0817 221/52
3,425,685 A 2/1969 Liva
3,606,125 A 9/1971 Tucker et al.
3,608,891 A 9/1971 Hannon et al.
3,652,174 A 3/1972 Boone
3,674,175 A 7/1972 Jaquish
3,777,929 A 12/1973 Hannon et al.
3,777,931 A * 12/1973 Fleming ..... A47K 10/422 221/57
3,785,523 A 1/1974 Goldstein
3,979,020 A 9/1976 Braber et al.
4,094,442 A 6/1978 Radek
4,118,085 A * 10/1978 Fibus ..... A47B 96/00 312/199
4,143,792 A 3/1979 Rex
4,234,101 A 11/1980 Pastore
4,249,460 A * 2/1981 McSwain ..... F24F 13/10 160/95
4,280,692 A * 7/1981 Hutchinson ..... B65H 1/04 271/127
4,311,252 A * 1/1982 Hope, Jr. ..... A47K 10/422 221/57
4,329,001 A * 5/1982 Filipowicz ..... A47K 10/427 221/53
4,372,549 A 2/1983 Stiernspetz
4,413,749 A 11/1983 Glaser
4,416,392 A * 11/1983 Smith ..... A47K 10/422 206/39.7
4,494,948 A 1/1985 Teyssier, Jr.
4,526,291 A 7/1985 Margulies
D282,574 S 2/1986 Case et al.
4,638,921 A 1/1987 Sigl et al.
4,662,536 A 5/1987 Powers
4,838,454 A * 6/1989 Salzmann ..... A47K 10/427 221/279
4,919,377 A 4/1990 Alexander et al.
4,938,382 A * 7/1990 Frazier ..... A47K 10/424 211/16
4,953,747 A * 9/1990 Wenkman ..... A47K 10/427 221/305
D310,923 S 10/1990 Breger
4,969,575 A * 11/1990 Kobayashi ..... A47K 10/422 221/45
5,011,010 A 4/1991 Francis et al.
5,076,466 A 12/1991 Petterson et al.
5,082,229 A 1/1992 Dahl
5,090,592 A * 2/1992 Petterson ..... A47K 10/424 221/55
5,100,020 A * 3/1992 Petterson ..... B65H 1/06 221/284
5,102,007 A 4/1992 Petterson et al.
5,123,566 A 6/1992 Lage et al.
5,131,561 A 7/1992 Casperson et al.
5,190,186 A 3/1993 Yablans et al.
5,199,599 A 4/1993 Shade
5,222,628 A 6/1993 Roethel
5,261,557 A 11/1993 Bytell et al.
5,269,409 A 12/1993 Brandt et al.
5,356,032 A 10/1994 Rhodes
5,513,773 A 5/1996 Cargill
5,515,999 A 5/1996 Jo
5,535,320 A 7/1996 Gay et al.
5,586,685 A 12/1996 Dorner et al.
5,616,113 A 4/1997 Van Den Bergh
5,630,581 A 5/1997 Rodesch
5,632,409 A 5/1997 Raghunanan
5,638,962 A * 6/1997 Price, Jr. ..... A47B 81/068 206/387.15
5,678,728 A 10/1997 Leto
5,690,230 A 11/1997 Griffith
5,743,605 A 4/1998 Marino
5,813,569 A 9/1998 Cihanek
5,823,344 A 10/1998 Fantone et al.
5,823,353 A 10/1998 Perrin et al.
5,857,791 A 1/1999 Kenney
5,865,340 A 2/1999 Alvern
5,894,931 A 4/1999 Dunn
5,908,137 A 6/1999 Pattarozzi
6,003,723 A 12/1999 Morand
6,056,133 A 5/2000 Luenser
6,145,231 A 11/2000 Valiulis
6,230,929 B1 5/2001 Phelps et al.
6,257,443 B1 * 7/2001 LaCount ..... A47K 10/427 221/35
6,286,713 B1 * 9/2001 Chan ..... A47K 10/427 221/49
6,331,696 B1 * 12/2001 Nakamura ..... A47K 10/422 219/386
6,334,544 B1 1/2002 Christensen et al.
6,354,462 B1 3/2002 Conran et al.
6,378,726 B1 4/2002 Chan et al.
6,386,389 B1 5/2002 Percy et al.
6,427,838 B1 8/2002 Fulda
6,440,052 B1 8/2002 Reider et al.
D463,184 S 9/2002 Tramontina et al.
6,457,605 B2 10/2002 Coleman
6,519,885 B2 2/2003 Valiulis
6,542,641 B1 4/2003 Andrew et al.
6,543,643 B2 4/2003 Iida et al.
6,592,118 B2 * 7/2003 Youn ..... B65H 1/12 271/147
6,655,544 B1 12/2003 Tanaka et al.
6,704,616 B2 3/2004 Formon
6,705,473 B1 3/2004 Schlesinger
6,726,014 B2 4/2004 Laurent
6,772,908 B2 8/2004 Roethel et al.
6,783,411 B2 * 8/2004 Pither ..... B63H 5/165 150/157

(56) References Cited

U.S. PATENT DOCUMENTS 6,789,694 B1 9/2004 McCullough
6,824,007 B2 * 11/2004 Timmers ..... A47K 10/427 221/47
6,830,151 B2 12/2004 Spencer et al.
6,871,755 B2 3/2005 DeVries et al.
6,874,653 B2 4/2005 Boone et al.
6,892,898 B1 5/2005 Boone et al.
6,929,147 B2 8/2005 Guillemette et al.
6,964,349 B2 11/2005 Sears et al.
6,981,610 B2 * 1/2006 Smiley ..... A47K 10/427 221/33
6,988,635 B2 1/2006 Hochtritt et al.
7,048,143 B2 5/2006 Sanders et al.
D524,084 S 7/2006 Wieser et al.
7,093,737 B2 8/2006 Tramontina et al.
7,124,911 B2 10/2006 Tramontina et al.
7,134,571 B2 * 11/2006 Hochtritt ..... A47K 10/424 221/44
7,178,689 B2 * 2/2007 Wieser ..... A47K 10/422 221/45
7,219,852 B2 5/2007 Tramontina et al.
7,234,610 B2 6/2007 Skarda et al.
7,370,860 B2 5/2008 James, III et al.
7,543,423 B2 6/2009 Long et al.
7,661,553 B2 * 2/2010 Zeiron ..... A47K 10/427 221/305
7,721,913 B2 * 5/2010 Nash ..... B42D 5/005 221/36
7,837,057 B2 * 11/2010 Zeiron ..... A47K 10/427 221/47
7,922,035 B2 4/2011 Long et al.
7,938,294 B2 * 5/2011 Cittadino ..... A47K 10/422 221/62
8,328,046 B2 12/2012 Hochtritt et al.
D675,851 S 2/2013 Wilson
D692,730 S 11/2013 Wilson, Jr. et al.
8,590,738 B2 11/2013 Formon et al.
D701,434 S 3/2014 Wilson, Jr.
D705,015 S 5/2014 Wilson, Jr. et al.
D705,016 S 5/2014 Wilson, Jr. et al.
D705,017 S 5/2014 Siebel
8,757,432 B2 * 6/2014 Muntzing ..... A47K 10/421 204/494
8,863,984 B2 10/2014 Siebel
8,881,943 B2 * 11/2014 Kobayashi ..... A47K 10/422 221/52
D729,541 S 5/2015 Wilson, Jr.
D740,049 S 10/2015 Wilson, Jr.
D745,336 S 12/2015 Rittfeldt et al.
D745,337 S 12/2015 Rittfeldt et al.
9,345,368 B2 5/2016 Formon et al.
9,433,331 B2 9/2016 Siebel
9,622,627 B2 * 4/2017 Wilson ..... A47K 10/422
9,901,221 B2 * 2/2018 Larsson ..... B65D 83/0805
9,901,222 B2 2/2018 Wilson et al.
9,986,876 B2 6/2018 Brickl et al.
10,004,366 B2 * 6/2018 Chalko ..... A47K 10/422
10,083,566 B1 * 9/2018 McPake ..... G07F 11/14
10,405,705 B2 9/2019 Formon et al.
10,602,890 B2 * 3/2020 Billman ..... A47K 10/427
2001/0020624 A1 9/2001 Hubanks et al.
2002/0030061 A1 3/2002 Formon
2002/0070228 A1 6/2002 Moody
2002/0139813 A1 10/2002 Boone et al.
2002/0179624 A1 12/2002 Tramontina
2003/0019880 A1 1/2003 Timmers et al.
2003/0057221 A1 3/2003 Guillemette et al.
2003/0062375 A1 4/2003 Christensen et al.
2003/0071050 A1 4/2003 Clark
2003/0080137 A1 5/2003 Clark et al.
2003/0116580 A1 6/2003 Baughman
2003/0146240 A1 8/2003 Kawolics
2004/0007586 A1 1/2004 Boone et al.
2004/0050857 A1 3/2004 Norton
2004/0178648 A1 9/2004 Moses
2004/0178948 A1 9/2004 Axelsson
2004/0222582 A1 11/2004 Widlund
2005/0056656 A1 3/2005 Hochtritt et al.
2005/0150898 A1 7/2005 Young et al.
2005/0199643 A1 9/2005 Smiley et al.
2006/0027590 A9 * 2/2006 Tramontina ..... A47K 10/425 221/46
2006/0076357 A1 4/2006 Braat et al.
2006/0086748 A1 4/2006 Burns
2006/0102641 A1 5/2006 Cittadino
2006/0102642 A1 5/2006 Muntzing et al.
2006/0169712 A1 8/2006 Yitzchaki
2006/0273100 A1 12/2006 Cittadino et al.
2006/0273101 A1 12/2006 Lewis et al.
2006/0273102 A1 12/2006 Wieser et al.
2007/0034638 A1 2/2007 Zeiron
2007/0152010 A1 7/2007 Denen et al.
2007/0215634 A1 9/2007 Levin
2008/0113855 A1 5/2008 Gooding, Jr.
2008/0135570 A1 6/2008 Lee
2008/0142536 A1 6/2008 Cohen et al.
2009/0212150 A1 8/2009 Wruck, Jr. et al.
2009/0272755 A1 11/2009 Burns
2009/0277920 A1 11/2009 Cittadino et al.
2010/0114366 A1 5/2010 Case et al.
2010/0224647 A1 9/2010 Formon et al.
2010/0274384 A1 10/2010 Nordlund et al.
2011/0095042 A1 4/2011 Bandoh
2011/0132920 A1 6/2011 Petocchi
2011/0174834 A1 7/2011 Case
2013/0161346 A1 6/2013 Wolme et al.
2014/0014675 A1 1/2014 Ingvarsson et al.
2014/0116913 A1 5/2014 Thorburn et al.
2014/0319164 A1 * 10/2014 Wilson ..... A47K 10/422 221/45
2015/0031257 A1 * 1/2015 Ootsubo ..... D04H 1/72 442/60
2016/0029857 A1 2/2016 Woerpel et al.
2016/0051100 A1 2/2016 Formon et al.
2016/0088982 A1 * 3/2016 Larsson ..... B65B 5/06 221/2
2016/0090229 A1 3/2016 Stenberg

FOREIGN PATENT DOCUMENTS

CN 1327427 A 12/2001
CN 2528370 Y 1/2003
CN 2546386 Y 4/2003
CN 1593318 A 3/2005
CN 1678228 A 10/2005
CN 1767779 A 5/2006
CN 101014272 A 8/2007
CN 101186075 A 5/2008
CN 101331063 A 12/2008
CN 101983027 A 3/2011
CN 102368941 A 3/2012
CN 202376008 U 8/2012
DE 19514431 A1 11/1995
EP 1238619 A2 9/2002
EP 1656870 A2 5/2006
EP 1693304 A1 8/2006
EP 2335541 A2 6/2011
EP 2850985 A2 * 3/2015 ..... A47K 10/427
FR 1285715 A 2/1962
FR 2538695 A1 7/1984
FR 2551964 A1 3/1985
FR 2732579 A1 10/1996
GB 2357080 A 6/2001
SE 0301297 B 5/1968
WO 0189354 A1 11/2001
WO 2004093629 A1 11/2004
WO 2005107546 A1 11/2005
WO 2005107548 A1 11/2005
WO 2006132618 A1 12/2006
WO 2006132696 A1 12/2006

(56) References Cited

FOREIGN PATENT DOCUMENTS

| | | | | | |
|---|---|---|---|---|---|
| WO | WO-2006132618 | A1 | * | 12/2006 | ..... A47K 10/422 |
| WO | 2013055340 | A1 | | 4/2013 | |
| WO | 2018054455 | A1 | | 3/2018 | |

OTHER PUBLICATIONS

Joel Palmer, Rolling Meadows parks pursues deal with Pepsi bottler, Sep. 24, 1997, Chicago Daily Herald, News; p. 4.
Plasticrafters Website, Displays2Go.com, Jan. 11, 2002, p. 1-2.

* cited by examiner

APPARATUS AND METHODS FOR PAPER DISPENSING

CROSS-REFERENCE TO RELATED APPLICATIONS

This application is related to co-owned application titled HORIZONTALLY ORIENTED PAPER PRODUCT DISPENSER AND RELATED METHODS, Ser. No. 16/718,950, filed on even date herewith, and the disclosure of which is hereby incorporated by reference in its entirety.

TECHNICAL FIELD

The present disclosure is generally related to dispensers and, more particularly, to dispensers of paper product and methods for dispensing such paper product.

SUMMARY

In one embodiment, a method is disclosed for loading a stack of interfolded paper units into a dispenser. The stack has a bottom surface, as well as an oppositely disposed top surface, with the bottom surface defining a footprint area of the stack. The method includes inserting the stack of interfolded paper units into an interior volume of the dispenser through a dispenser opening, with the dispenser including a lid that is connected to a remainder of the dispenser for selectively covering the dispenser opening. The lid has a dispensing aperture, as well as a movable platen that has a paper-engaging surface, and which is urged upwardly toward the dispenser opening. A bottom wall of the dispenser is disposed opposite the dispenser opening, and a lock of the dispenser is selectively engageable with the platen.

The method includes placing the stack on the paper-engaging surface of the platen in the interior volume of the dispenser, and exerting a downward force on the top surface of the stack to thereby push the platen downward. Downward movement of the platen is effective to pivot the lock about a lock axis in a first direction, with the lock being biased to move in a second direction opposite the first direction. Exertion of the downward force is ceased when the platen has been engaged by the lock and has reached a locked position in which the paper-engaging surface has an oblique orientation relative to the bottom wall of the dispenser. The method further includes pivoting the lid about a lid axis from an open position toward a closed position of the lid, to thereby cause pivoting movement of the lock in the first direction. Pivoting movement of the lock in the first direction is effective to cause the lock to disengage from the platen. The method also includes extending a portion of an individual paper unit from the top surface of the stack through the dispensing aperture of the lid, to thereby dispense that individual paper unit.

In another embodiment a napkin dispenser is provided. The napkin dispenser includes a bottom wall and a plurality of sidewalls that jointly define an interior volume of the dispenser for storing napkins therein. A lid is connected to one or more of the sidewalls for selectively allowing access into the interior volume. The lid includes a dispensing aperture that is configured to allow extraction of the napkins one at a time from the interior volume. The dispensing aperture has an elongated shape and includes a length dimension, as well as a width dimension. The dispensing aperture has a centrally located section, and a pair of slotted sections each extending from the centrally located section. The centrally located section has a length that is no greater than about 40 mm, and each of the slotted sections has a width that is no greater than about 13 mm.

In yet another embodiment, a napkin dispenser is provided that includes a bottom wall and a plurality of sidewalls, with that bottom wall and the sidewalls jointly defining an interior volume of the dispenser for storing napkins therein. The dispenser includes a lid that is connected to one or more of the sidewalls for selectively allowing access into the interior volume, with the lid having a dispensing aperture that is configured to allow extraction of the napkins one at a time from the interior volume. The lid is pivotally movable relative to the sidewalls between an open position and a closed position. The dispenser also includes a platen that is movable between a bottom position proximate the bottom wall, and a top position. A first biasing element is coupled to the platen and urges the platen toward the top position of that platen. The dispenser also includes a lock associated with one or more of the sidewalls and which has a locked condition in which the lock prevents the platen for moving towards the top position of the platen, and also an unlocked condition in which the platen is permitted to move toward the top position of the platen. The platen is configured to move the lock into the locked condition as the platen moves toward the bottom position of the platen. Pivoting movement of the lid from the open position to the closed position of that lid is configured to move the lock toward the unlocked condition of the lock.

In another embodiment a system for dispensing napkins is provided, which includes a dispenser for storing and dispensing individual napkins from a stack of such napkins. The dispenser in that system has a bottom wall and a plurality of sidewalls jointly defining an interior volume of the dispenser for storing the napkins. A lid of the dispenser is hingedly coupled to one or more of the sidewalls for selectively allowing access into the interior volume, with the lid including a dispensing aperture that is configured to allow extraction of the napkins one at a time from the interior volume. The system further includes a stack of interfolded napkins in the interior volume of the dispenser, with that stack having a generally rectangular footprint. The rectangular footprint includes a length not exceeding about 115 mm, and a width not exceeding about 95 mm. The dispensing aperture has an elongated shape and includes a length dimension and a width dimension. The dispensing aperture has a centrally located section, and a pair of slotted sections each extending from the centrally located section. The centrally located section has a length that is no greater than about 40 mm, and each of the slotted sections has a width that is no greater than about 13 mm.

In specific embodiments, the stack has a height that is no greater than about 110 mm, and a number of interfolded napkins that is no greater than about 120. The stack may include a top surface, a first pair of surface edges parallel to one another, and a second pair of surface edges orthogonal to the first pair of surface edges, with the first and second pairs of surface edges jointly defining a perimeter of the top surface of the stack. The top surface in those embodiments may include a linear gripping tab that is generally parallel to the first pair of surface edges, and which extends between the second pair of surface edges. In those embodiments, the stack may be located in the interior volume of the dispenser such that the gripping tab is accessible only through the centrally located section of the dispensing aperture. In those or other specific embodiments, the stack may be oriented in the interior volume of the dispenser such that the linear gripping tab is orthogonal to the length dimension of the dispensing aperture.

BRIEF DESCRIPTION OF THE DRAWINGS

The objectives and features of the invention will become more readily apparent from the following detailed description taken in conjunction with the accompanying drawings in which.

DETAILED DESCRIPTION OF PARTICULAR EMBODIMENTS

To the extent that any meaning or definition of a term in this written document conflicts with any meaning or definition of the term in a document incorporated by reference, the meaning or definition assigned to the term in this written document shall govern. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Also, as used herein, the term "releasable coupling" and related terms refer to a type of coupling in which the coupled structures may be readily detached, decoupled, or otherwise separated from one another in a simple manner and without causing the destruction or damage of any of those structures. For sake of further explanation, a permanent—rather than "releasable"—type of coupling may refer, for example, to two structures that are integrally formed with one another, or which are adhesively attached, such that their separation would necessarily result in at least some level of damage to one or more of the parts being separated.

Figure 1:
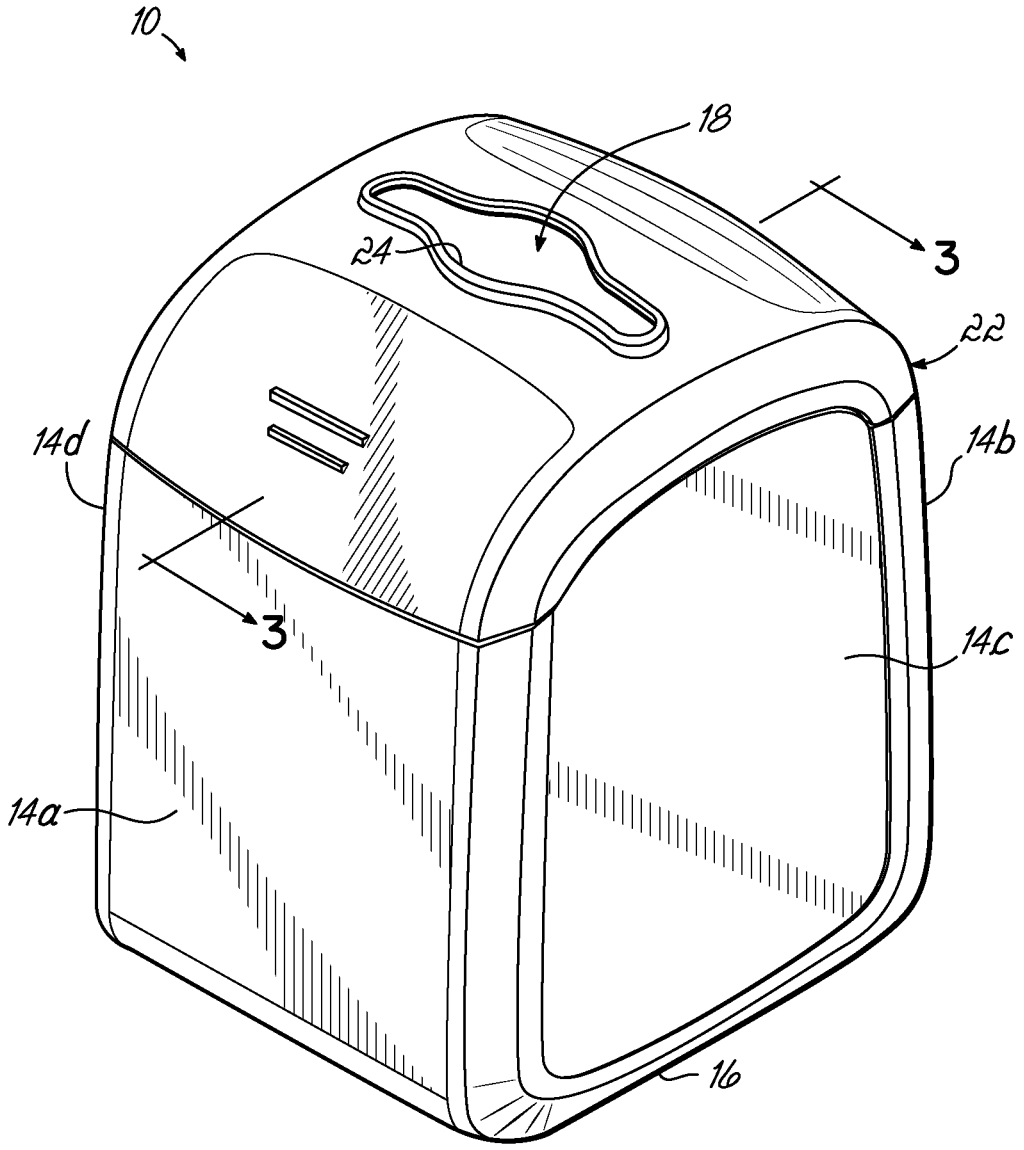
FIG. 1 is a perspective view of a dispenser for storing and dispensing individual paper units from a stack of such paper units in accordance with one embodiment of the invention.
Figure 2:
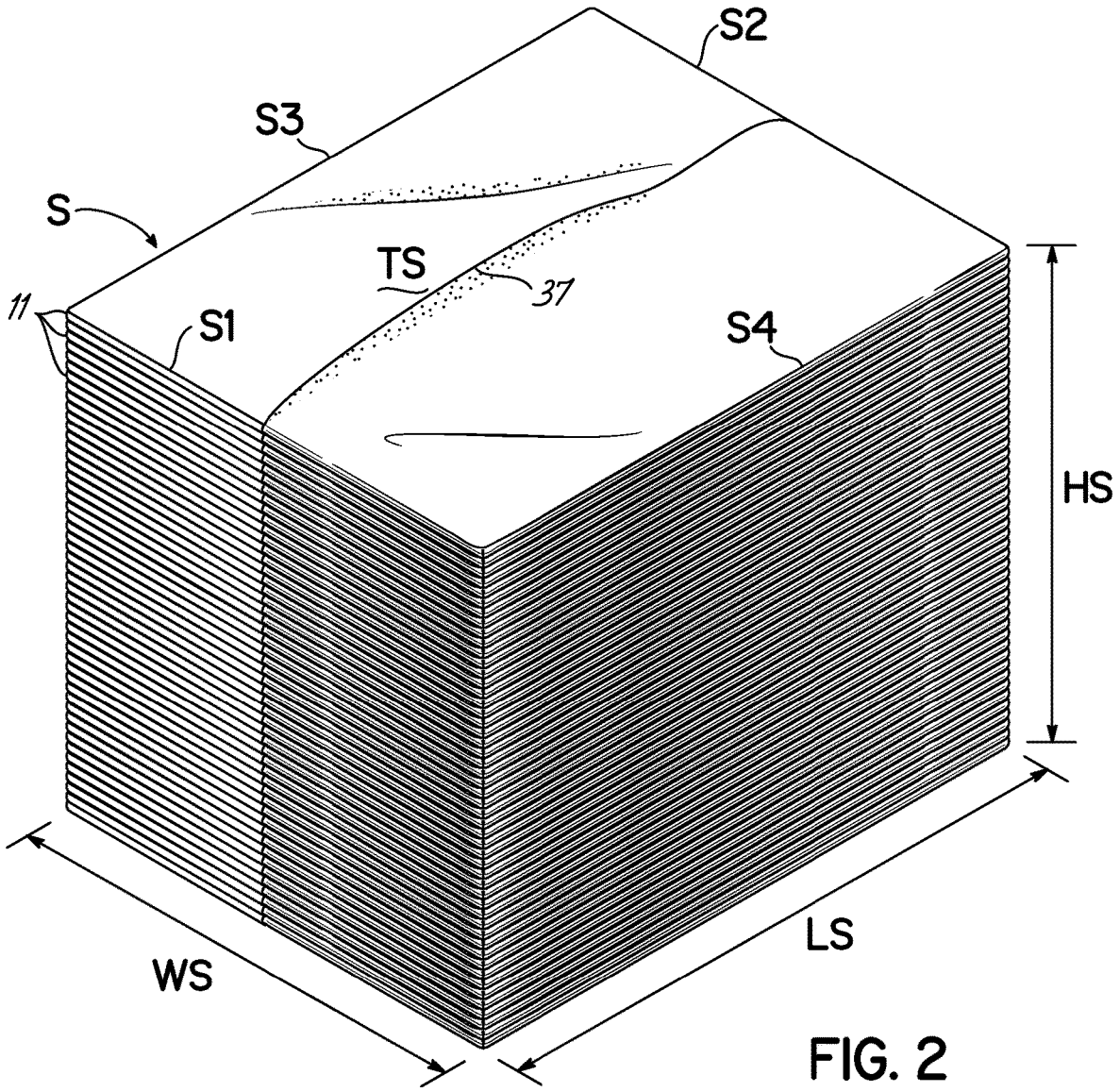
FIG. 2 is a perspective view of a stack of individual paper units in accordance with one embodiment of the invention.
Figure 3:
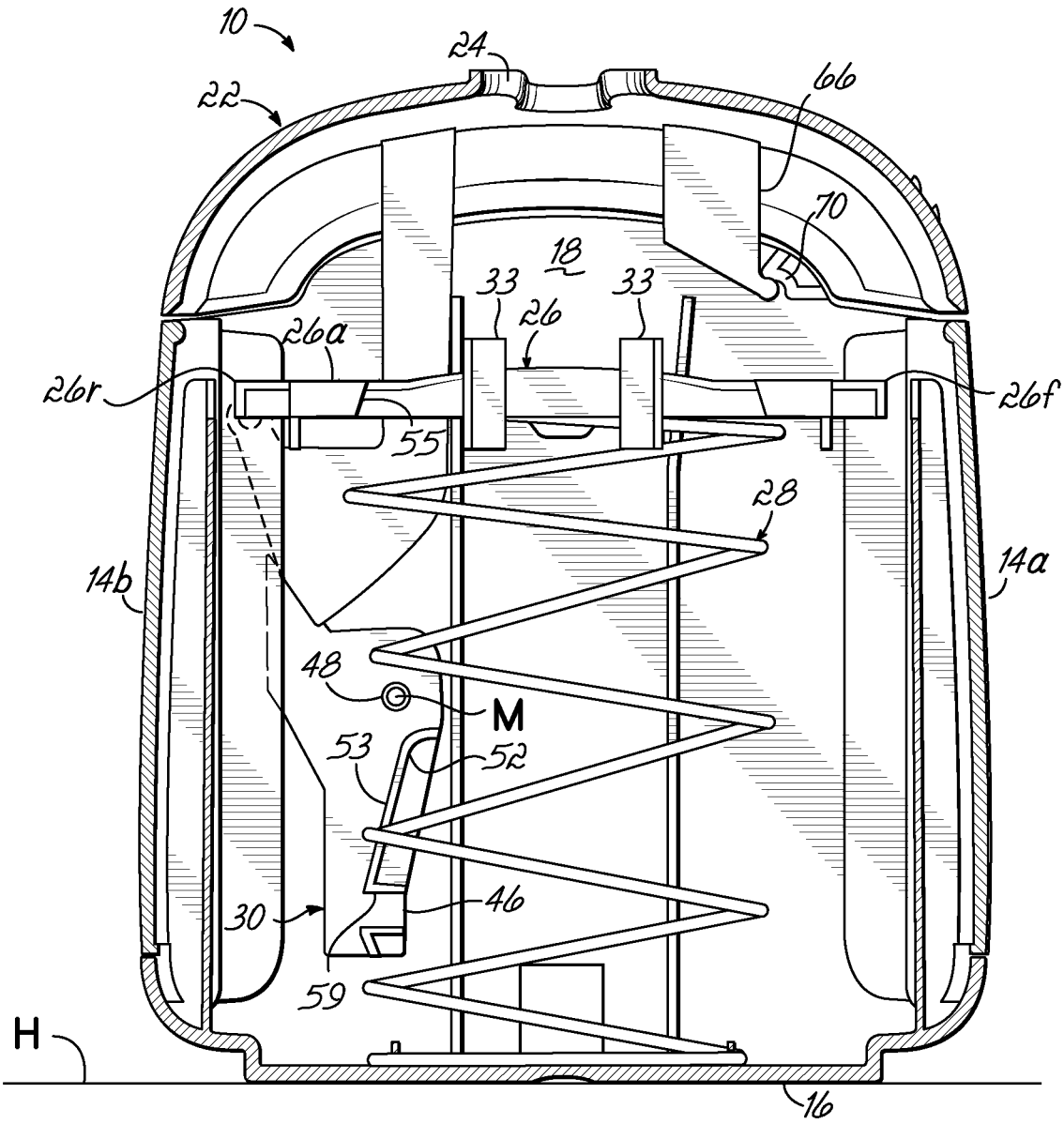
FIG. 3 is a cross-sectional view of the dispenser of FIG. 1 taken generally along line 3-3 of FIG. 1.

With reference to the figures, and more particularly to FIGS. 1, 2, 3, 4, and 5, an illustrative apparatus in the form of a dispenser 10 is shown for dispensing individual paper units such as napkins 11 from a stack S of those napkins 11 (FIG. 2). While the description herein refers to the individual paper units as napkins, it is contemplated that other types of paper units such as facial tissue or hand towel sheets may be used in the manner described herein and are therefore considered to fall within the scope of the present disclosure. As shown particularly in FIGS. 1 and 3-5, dispenser 10 is made up of a plurality of sidewalls, which include—with respect to the orientation in the illustrative figures—a front wall 14*a*, a rear wall 14*b* disposed opposite front wall 14*a*, and two lateral walls 14*c*, 14*d* that extend between the front and rear walls 14*a*, 14*b*. A bottom wall 16 of dispenser 10 spans the space between sidewalls 14*a*, 14*b*, 14*c*, and 14*d* and jointly with those sidewalls defines an interior volume 18 of dispenser 10, suitable to store a stack S of napkins 11 for dispensing of those napkins to the exterior of dispenser 10.

Figure 4:
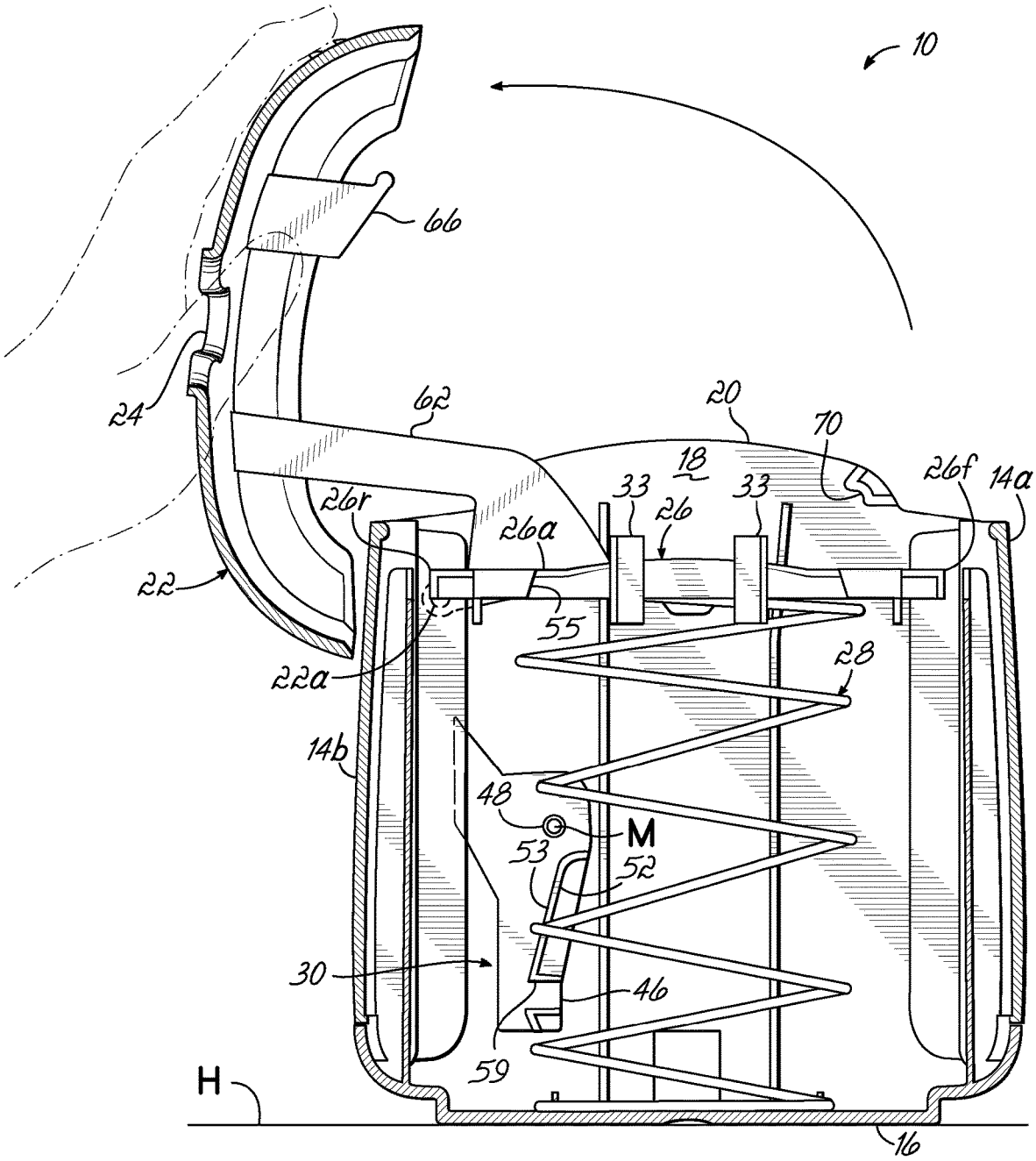
FIG. 4 is a view similar to FIG. 3, showing a lid of the dispenser in an open position.
Figure 5:
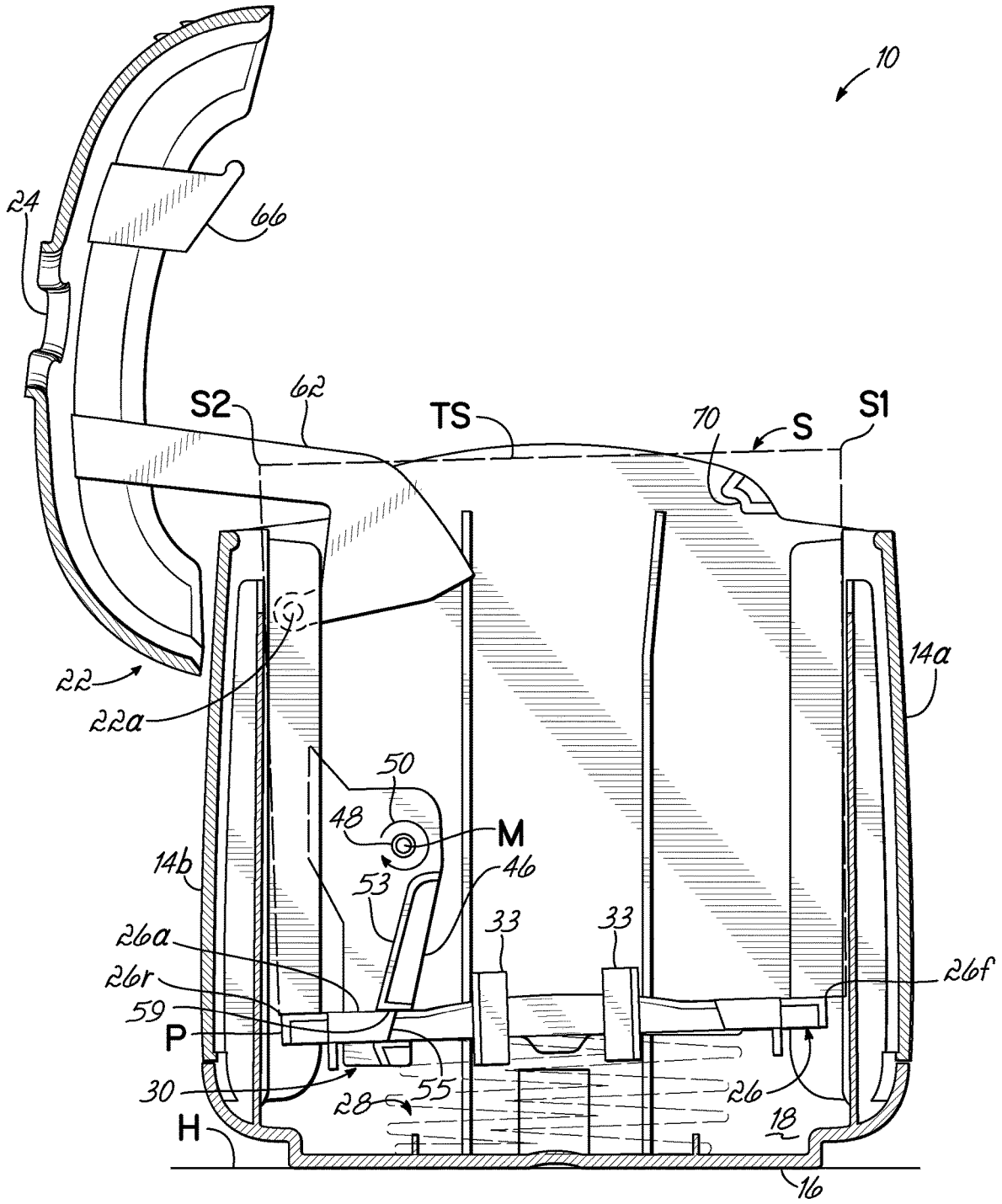
FIG. 5 is a view similar to FIGS. 3 and 4, showing a platen of the dispenser in a locked position and schematically showing the stack of FIG. 2 in an interior volume of the dispenser.

Bottom wall 16 is a generally planar structure and is configured to rest on a generally horizontal surface H, such as a countertop, and in that regard may include one or more feet (not shown) on its exterior-facing surface. Sidewalls 14*a*, 14*b*, 14*c*, 14*d* jointly define a top opening 20 (FIG. 4) of dispenser 10 into the interior volume 18 of that dispenser. A lid 22 of dispenser 10 is hingedly coupled to lateral walls 14*c*, 14*d* for pivoting motion of that lid 22 about a lid axis 22*a*, between a closed position substantially preventing access into interior volume 18 (FIGS. 1 and 3), and a fully opened position providing such access (FIGS. 4 and 5). Lid 22 includes a dispensing aperture 24 that allows napkins 11 in the interior volume 18 to be dispensed to the exterior, for example one by one (i.e., one at a time). As more fully explained below, dispensing aperture 24 is configured to limit contact of the napkins 11 in interior volume 18 with human fingers, thereby minimizing the likelihood of contamination of napkins 11.

Dispenser 10 also includes a movable platen 26 in its interior volume 18, that is urged upwardly by a biasing element such as a compression spring 28 that is coupled at one end to the interiorly-facing side of bottom wall 16, and at the other end to an underside of platen 26. Platen 26 is movable between a bottom-most position associated with maximum compression of spring 28, and a top-most position at which platen 26 is adjacent top opening 20 of dispenser 10 and associated, in specific embodiments, with an uncompressed state of spring 28. Other embodiments are contemplated in which a different type of biasing element is used, which may be another type of spring, such as a leaf spring or another type of spring, or some other element having resilient properties (e.g., a compressible rubber ball).

With continued reference to FIGS. 1-5, platen 26 includes a paper-engaging top surface 26*a* that is configured to support, from the bottom, a stack S of the napkins 11. When the dispenser 10 is full of napkins 11, the platen 26 may be at the bottom-most position of that platen 26, which defines the tallest stack of napkins that will effectively fit in interior volume 18 while being supported by paper-engaging surface 26*a*, or somewhere short of that bottom-most position. The bottom-most position of platen 26, in the illustrated embodiment, may be associated with the state of generally maximum or near maximum compression of spring 28. With particular reference to FIG. 5, platen 26 has a locked position P, proximate bottom wall 16, that is short of the bottom-most position of platen 26, which allows dispenser 10 to accommodate more napkins 11 than is apparent from the locked position P of the platen 26. In the locked position P, platen 26 is unable to move upward unless a locking mechanism 30 of dispenser 10 is disengaged from platen 26.

Notably, at position P, the paper-engaging surface 26*a* is oriented obliquely relative to bottom wall 16, and also relative to the horizontal surface H on which dispenser 10 rests, which effectively causes a top surface TS of stack S to similarly be obliquely oriented. The inventors have identified an oblique orientation of top surface TS to be particularly advantageous to prevent overstuffing of dispenser 10 with napkins 11, which is desirable to prevent malfunction of dispenser 10. As shown in the figures, the oblique orientation of top surface TS is such that a front edge S1 of top surface TS, which is closer to the person loading dispenser 10 with napkins 11 (adjacent the top of front wall 14*a* of dispenser 10), is higher than oppositely disposed rear edge S2 of top surface TS in the locked position P of platen 26.

The relatively higher level of front edge S1—relative to the opposite rear edge S2 of top surface TS—provides the person loading the stack into dispenser 10 with a perception of having filled dispenser 10 to capacity or beyond capacity. This perception, accordingly, minimizes the likelihood of overstuffing the dispensers with additional napkins, compared to a hypothetical substantially horizontal orientation of top surface TS, which would lead that person to believe that more napkins 11 can fit in interior volume 18. Minimization of overstuffing protects the moving components of dispenser 10 from malfunctioning, and provides for reliable, consistent dispensing without tearing of the napkins 11 as they are extracted through aperture 24.

On the other hand, the oblique orientation of top surface TS may undesirably concentrate the force exerted by stack S—during dispensing—against one of the edges of dispensing aperture 24, rather than uniformly across all edges defining such aperture 24. If the quality of paper from which napkins 11 are made is low, that uneven concentration of forces against aperture 24 may cause the paper napkins 11 to tear during dispensing, which would be detrimental to the experience by the end user of the dispenser. Additionally, the oblique orientation of top surface TS may provide the person loading the dispenser the false impression that something is broken in dispenser 10, which may lead to undesirable manipulation of the components of dispenser 10. That undesirable manipulation may ultimately lead to failure of those components. The oblique orientation of stack S, as a whole, may also be detrimental in cases in which the substrate making up the napkins 11 has a low friction, which may cause the stack S to become destabilized and slide or collapse during loading or during use.

The angle of orientation of paper-engaging surface 26*a* relative to bottom wall 16 and also relative to the horizontal surface H on which dispenser 10 rests—in specific embodiments—may be between about 3 and about 20 degrees, specifically between about 3 and about 15 degrees, and more specifically between about 5 and about 10 degrees. One suitable angle of orientation for paper-engaging surface 26*a*, for example, may be about 7 degrees. An angle of about 7 degrees has been found to provide the right balance between providing the desired effect described in the preceding paragraph, while preventing or at least minimizing the likelihood of collapse of a stack S within dispenser 10, particularly for stacks S made up of napkins made of a material having a low coefficient of friction. For napkins made of materials having a relative high coefficient of friction, accordingly, an angle greater than about 10 degrees and as high, for example, as about 20 degrees may be used.

Figure 6:
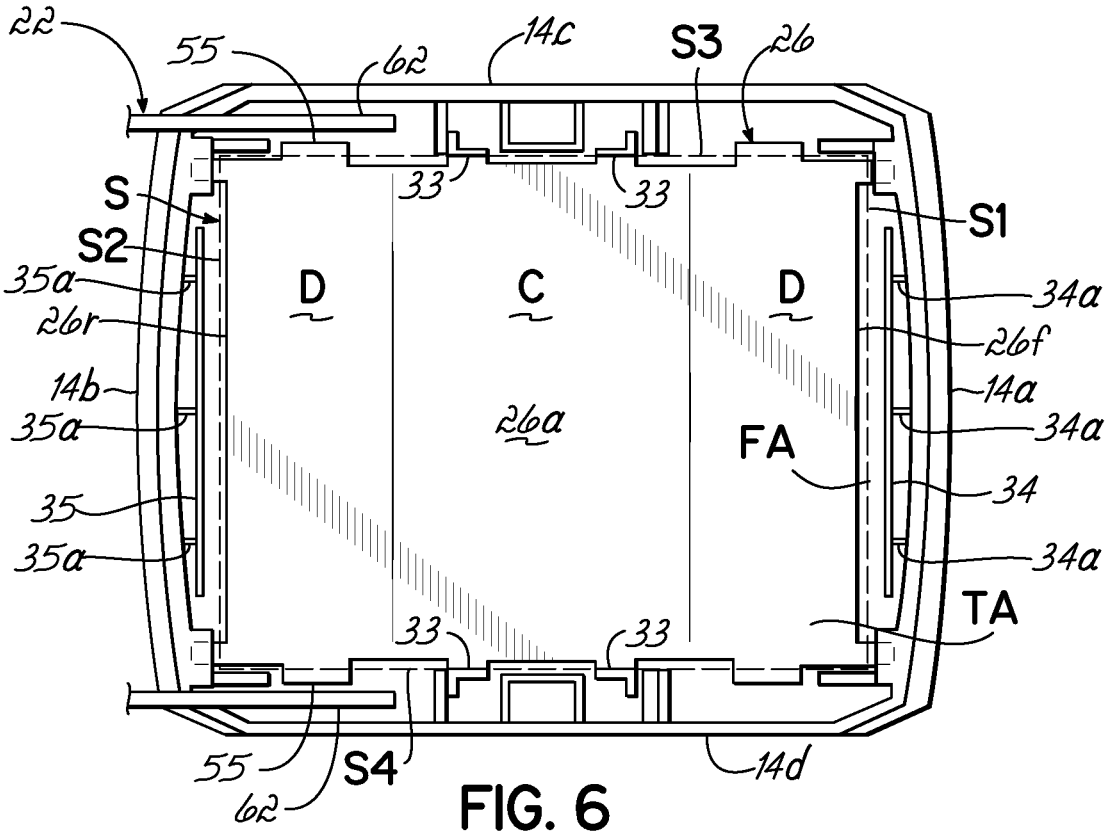
FIG. 6 is a partial, top view of the dispenser in FIGS. 1 and 3-5, with the lid of the dispenser in an open position and showing a top, paper-engaging surface of the platen of the dispenser, as well as a stack (schematically) resting on that surface.

With continued reference to FIGS. 1-5, and further referring to FIG. 6, the platen 26 not only provides the oblique orientation of paper-engaging surface 26*a* as described above, but it is also configured to minimize lateral movement of the stack S in interior volume 18 i.e., movement toward and away from the lateral walls 14*c*, 14*d*. More specifically, platen 26 includes a plurality of tabs 33 protruding upwardly from the side edges of platen 26, and which are configured to laterally support stack S. Further, dispenser 10 includes a pair of upright, flat supports 34, 35 respectively adjacent front and rear walls 14*a*, 14*b*, and which are connected to those walls 14*a*, 14*b* through respective sets of ribs 34*a*, 35*a* that conform—in the example embodiment of the figures—to the arcuate shape (when seen from above) of front and rear walls 14*a*, 14*b*. Flat supports 34, 35 provide support to stack S, preventing forward and backward movement (i.e., respectively toward front and rear walls 14*a*, 14*b*) of stack Sin interior volume 18.

Jointly, the lateral distance between the inward-facing surfaces of tabs 33, and the longitudinal distance between the inner-facing surfaces of flat supports 34, 35 define a total effective support area TA of paper-engaging surface 26*a* available to support a stack S. The stack S of napkins 11, in that regard, is designed so that a footprint area FA of that stack S closely matches the total area TA, so as to minimize undesirable lateral or longitudinal movement of stack S within dispenser 10 while stack S is stored in interior volume 18, and particularly during dispensing. The relatively close match between areas TA and FA advantageously facilitates portability of a dispenser 10, loaded with napkins 11 in its interior volume 18. Specifically, the relatively close match between areas TA and FA allow a preloaded dispenser to be moved, for example, from one table of a restaurant to another, with little concern for collapsing of the stack within dispenser 10, which would otherwise potentially be detrimental to the napkin-dispensing operation.

For example, the ratio of the footprint area FA of stack S to the total effective area TA may be in the range between about 0.7 and about 1.0, or specifically in the range between about 0.85 and about 1.0, or more specifically, in some embodiments, in the range between about 0.95 and about 1. A ratio of at least about 0.7 may suffice to provide the desired level of lateral and longitudinal support to stack S for napkins made of a substrate having relatively high coefficient of friction values (i.e., friction between adjacent napkins). That ratio, however, may not suffice for napkins 11 having a lower coefficient of friction value, in which case a ratio of at least about 0.85 may be required in order to properly support a stack S in interior volume 18. A ratio of at least about 0.95 is superior in that proper support of stack S is attainable without much concern for the coefficient of friction value of the napkins 11. It is understood, however, that higher ratios may require low tolerances in the manufacturing process for napkins 11, which is typically attained with more complex (and costlier) manufacturing processes. In other words, if the target is to attain a ratio of about 1, for example, the manufacturing process for the stack S of napkins 11 would require that all napkins are perfectly aligned with one another in the stack S and that the width and length of the stack do not exceed the limit provided by the spacing provided by the inward-facing surfaces of support tabs 33 and flat supports 34, 35.

The close match between the footprint area FA of stack S and the total effective area TA of paper-engaging surface 26*a* offers an additional advantage. That close match also results in minimization of the space between the stack S and the sidewalls 14*a*, 14*b*, 14*c*, 14*d*, which reduces the volume available for debris and other types of contaminants to accumulate in interior volume 18. That, in turn, reduces the likelihood of malfunction of the dispenser 10, particularly over an extended period of time, thereby lengthening the useful life of dispenser 10.

With continued reference to FIGS. 1-6, and particularly referring to FIG. 2, the stack S of napkins 11, in the example embodiment shown in that figure, is made of a plurality of napkins 11 that are interfolded (i.e., interleaved), such the pulling of one napkin 11 though dispensing aperture 24 is effective to pull the next napkin in the stack S through frictional engagement between adjacent, interfolded napkins. Stack S in the illustrative embodiment of FIG. 2 has a number of Z-folded napkins 11 in a number of about 120, although other types of folds and/or a different number of napkins are similarly contemplated. The footprint area FA of that stack S (FIG. 6) is generally rectangular and may be such that the length LS and width WS of stack S do not exceed, respectively, about 115 mm and about 95 mm, which respectively correspond to the longitudinal distance between the inward-facing surfaces of flat supports 34, 35 and the lateral distance between the inward-facing surfaces of support tabs 33. In one example embodiment, the length LS and width WS of stack S are respectively about 107 mm and 84 mm. Stack S has a height HS that may, for example, be no greater than about 110 mm, which is a height that has been found to yield a stack with a suitable number of napkins S and which prevents overstuffing of the dispenser 10 beyond its intended capacity.

The example stack S of FIG. 2 has a generally rectangular cross-section such that the top surface TS defines a first pair of oppositely disposed, parallel surface edges S1, S2, and a second pair of oppositely disposed surface edges S3, S4, which are also parallel to one another. In this embodiment, accordingly, the surface edges S1, S2 of the first pair are generally orthogonal to the surface edges S3, S4 of the second pair. In the example stack S of FIG. 2, each of the napkins 11 is folded in such a manner that the top surface TS is provided with a generally linear gripping tab 37 that is generally parallel to the second pair of surface edges S3, S4 and which extends between the first pair of surface edges S1, S2. In the illustrative stack S of the figures, the gripping tab 37 is located centrally between the second pair of surface edges S3, S4, although alternative stacks are contemplated in which the gripping tab 37 is not centrally located between surface edges S3, S4 (i.e., it may be located closer to surface edge S3 than it is to surface edge S4 or vice versa), or in which the gripping tab 37 has shape other than that shown (e.g., a non-linear tab). Yet other alternative stacks are contemplated having no gripping tab 37 at all.

Figure 7:
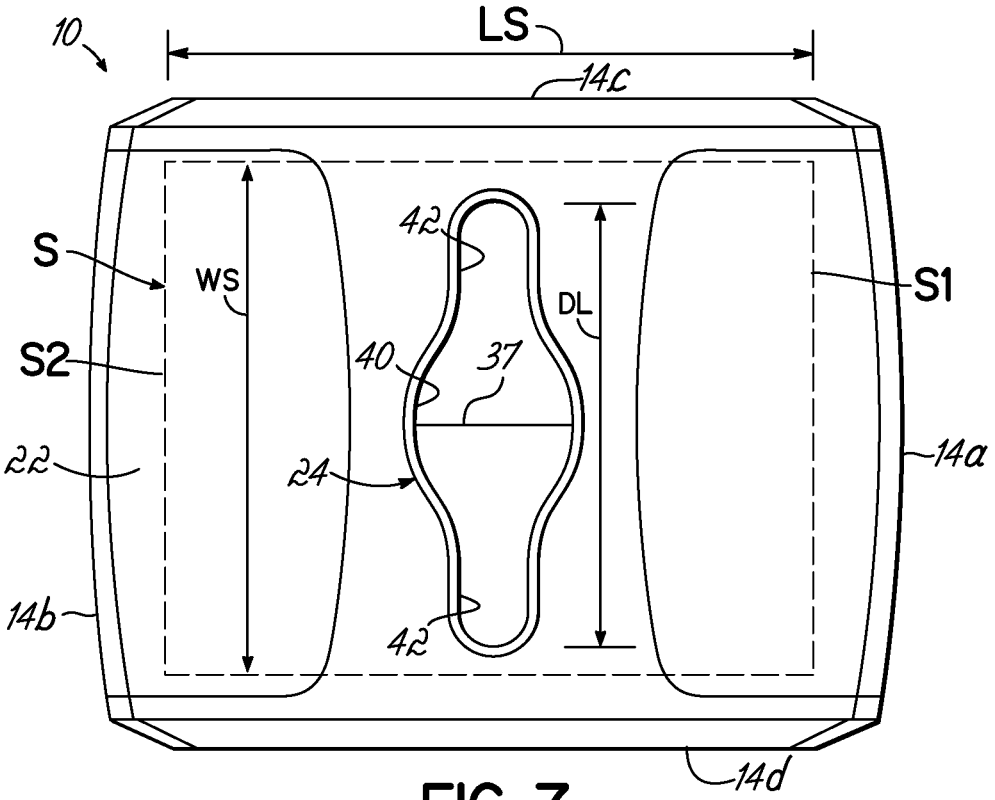
FIG. 7 is a top view of the dispenser of FIGS. 1 and 3-6, with the lid of the dispenser in a closed position and a stack in the interior volume of the dispenser.
Figure 7A:
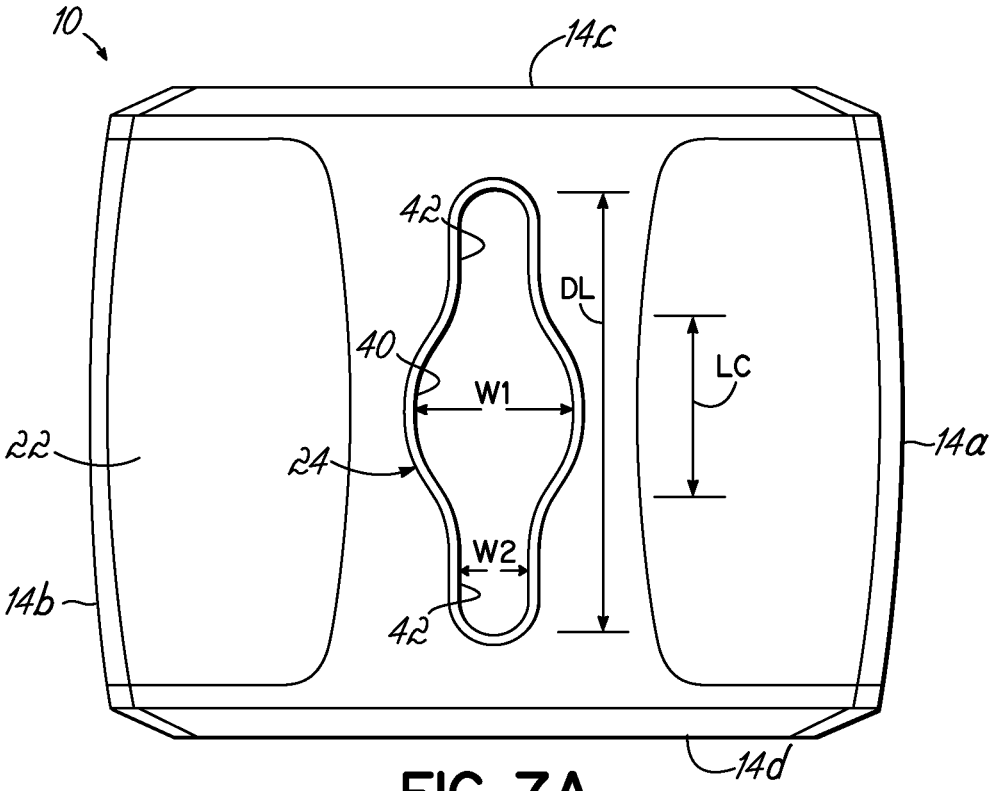
FIG. 7A is another top view of the dispenser of FIGS. 1 and 3-6, showing additional features of that dispenser.
Figure 8:
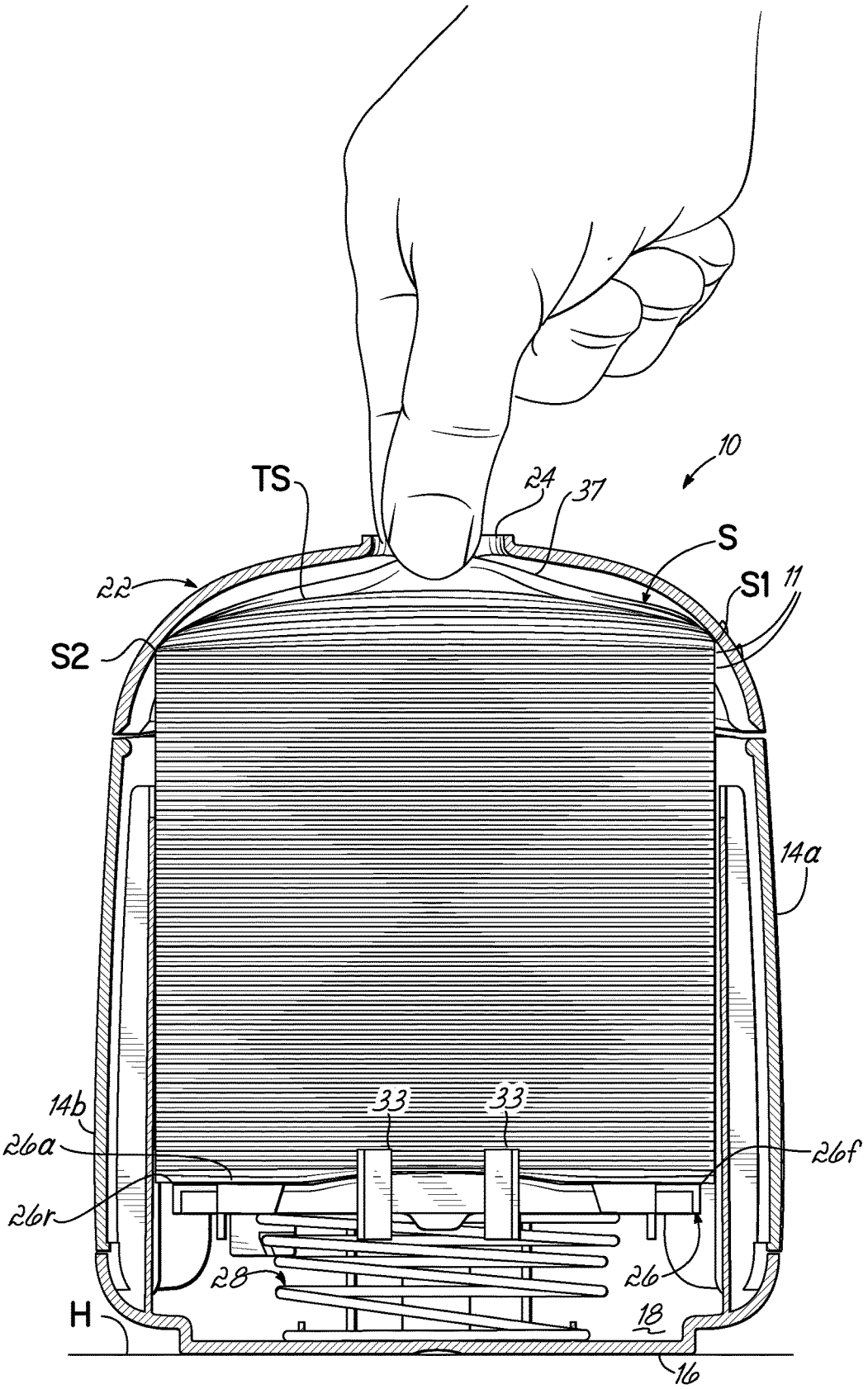
FIG. 8 is a view similar to FIGS. 3-5, showing a stack in the interior volume of the dispenser and extraction of a portion of a topmost paper unit of that stack through a dispensing aperture of the dispenser.
Figure 9:
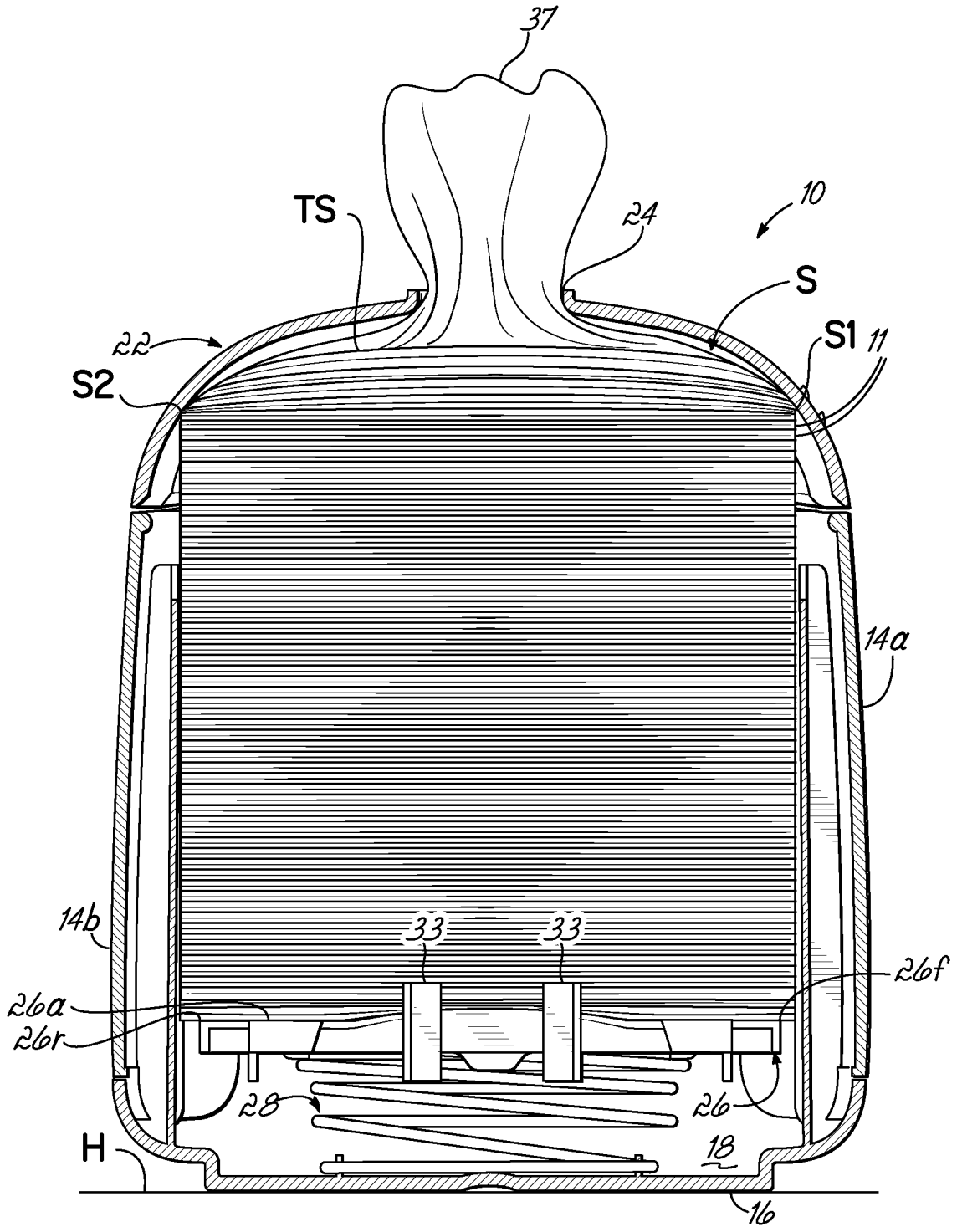
FIG. 9 is a view similar to FIG. 8, showing the stack of individual paper units ready for dispensing.

With continued reference to FIGS. 1-6, and further referring to FIGS. 7, 7A, 8, and 9, the centralized location and shape of gripping tab 37 in the example stack S of the figures advantageously cooperate with the shape of dispensing aperture 24 to facilitate loading of the stack S into dispenser 10 for dispensing of the napkins 11 from stack S. Specifically, the stack S is loaded into the interior volume 18 of dispenser 10 and the lid 22 pivotally moved to the closed position. The person loading the dispenser 10 may then be able to pinch the gripping tab 37 using the thumb and forefinger, and extend the gripping tab 37 through the dispensing aperture 24 toward the exterior, thereby making the napkins 11 available for dispensing (FIGS. 8 and 9). To that end, the stack S may be loaded into interior volume 18 in an orientation such that the longitudinal dimension of gripping tab 37 is oriented transversely to the length dimension of dispensing aperture 24, as shown in FIG. 7. The shape and dimensions of dispensing aperture 24 are configured for that type of operation, thereby favoring stacks with a gripping tab—if one is present in the stack S—shaped and located as in the illustrated embodiment, while at least hindering the loading of stacks S having no gripping tab 37 at all or having a gripping tab located outside a centrally located section ("central section") 40 of dispensing aperture 24.

More specifically, each of a pair slotted sections 42 extending from central section 40 has a width W2 that the inventors have found to be sufficiently narrow to prevent the average human adult forefinger and thumb from accessing interior volume 18 through those slotted sections 42. The width W2 of the slotted sections may for example be no greater than about 13 mm, and more specifically less than about 12 mm, and in some embodiments between about 10 and about 11 mm. The relatively small width W2 prevents an average-sized adult human forefinger and thumb from accessing the top surface TS of stack S, which minimizes the likelihood of contamination of the stack S in interior volume 18, yet allows each napkin to protrude ready for dispensing in a semi-opened state, as shown in FIG. 9, for example. The small width W2 of the slotted sections 42, additionally, makes it difficult for the topmost napkin 11 in the stack S to be grabbed and pulled through dispensing aperture 24, unless that napkin 11 is grabbed through the central section 40. To that end, the absence of a gripping tab 37, particularly in stacks S having napkins with high coefficient of friction values, creates difficulty in the ability to grab the topmost napkin 11 and extend at least a portion of that napkin through aperture 24. Napkins with a relatively low coefficient of friction value, conversely, may not require a gripping tab at all, insofar as the topmost napkin 11 may be easy to slide relative to adjacent napkins, thereby allowing the user to grab that topmost napkin and extend at least a portion of that napkin through dispensing aperture 24.

Other aspects of the shape of dispensing aperture 24 are similarly designed to provide specific advantages to embodiments having such shape of dispensing aperture. For example, the overall length DL of the dispensing aperture 24 (i.e., the dimension spanning the space between lateral walls 14*c*, 14*d*) is configured to be less than the expected width WS of the stack S (i.e., the dimension of the stack parallel to the length dimension of the dispensing aperture 24). That feature forces the topmost napkin 11 protruding through dispensing aperture 24 to bend slightly, thereby attaining an upright attitude, ready for withdrawal by a user, as shown in FIG. 9. The overall length DL, for example, may be about 77 mm, which is a dimension suitable for stacks having a width WS of about 84 mm—with that combination of dimensions having been found to facilitate upright standing of certain types of napkins 11 through dispensing aperture 24, while allowing for smooth, consistent dispensing of those napkins 11. The precise suitable combination of length DL and width WS may depend on the coefficient of friction value of the napkins 11.

Additionally, the length LC and width W1 of the central section 40 are configured to allow an average adult human thumb and forefinger to pinch the gripping tab 37, in the manner shown in FIG. 8, while minimizing the overall area of that central section 40. In that regard, the length LC of central section 40 may for example be no greater than about 40 mm, while the width W1 of that central section 40 may for example be no greater than about 30 mm. Minimization of the overall area of central section 40, in turn, advantageously minimizes exposure of the napkins 11 in interior volume 18 to the exterior through dispensing aperture 24, which in turn reduces the likelihood of contamination of those napkins 11. A disadvantage of the relative small size of central section 40, however, is that it may impede or at least hinder the pinching or otherwise grabbing of a portion of the topmost napkin 11 in the stack S during loading, and specifically during preparation of the stack S for dispensing, particularly—for example—for persons having above-average sized fingers.

With continued reference to FIGS. 3-5, 8, and 9, and further referring to FIGS. 10, 11, 12, 13, and 14, dispenser 10 has a pair of locks 46, jointly making up locking mechanism 30, and which are respectively coupled to each of the lateral walls 14*c*, 14*d*. Locks 46 are effective to selectively immobilize platen 26 in the locked position P of that platen 26 (FIG. 5) during loading of the stack S into the interior volume 18. Immobilization of platen 26 during loading of stack S facilitates the loading operation, such as by permitting a single-handed loading operation. For ease of explanation and understanding, the following lines describe the structure and operation of one of those two locks 46, being understood that the same principles and description apply similarly to the other one of the locks 46. Each lock 46 is pivotally coupled to an interior-facing surface of one of the lateral walls 14*c*, 14*d* at pivoting location M. A torsion spring 48 at location M urges a bottom portion of lock 46 in a biased direction 50 (FIG. 5), toward the rear wall 14*b* of dispenser 10, although it is understood that alternative embodiments may use other types of biasing element, whether at location M or at another location associated with lock 46, yet being effective to urge the lock in the biased direction 50.

Figure 5A:
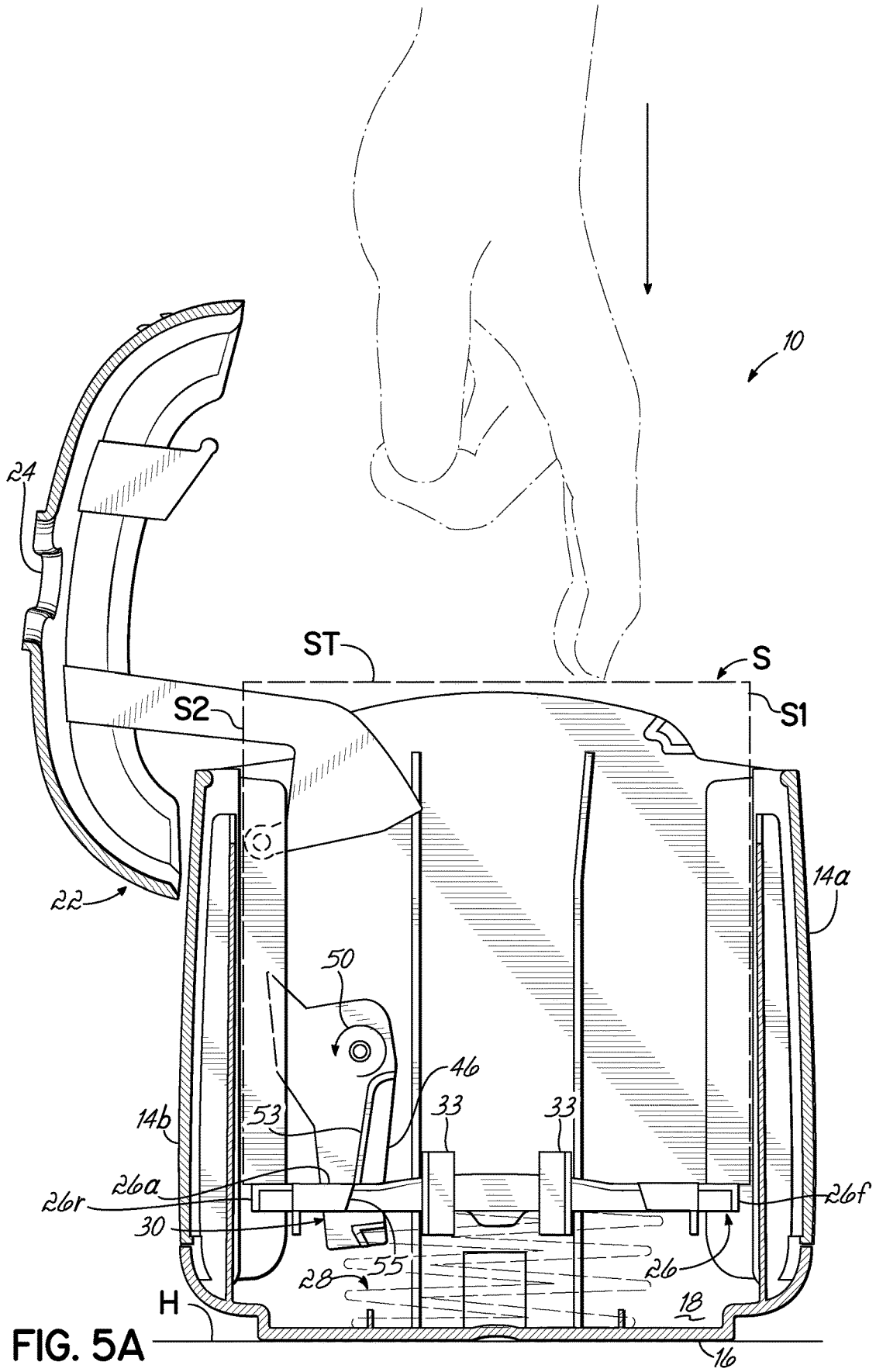
FIG. 5A is a view similar to FIG. 5, showing the platen of the dispenser in an unlocked position and schematically showing the stack of FIG. 2 in the interior volume of the dispenser.
Figure 12:
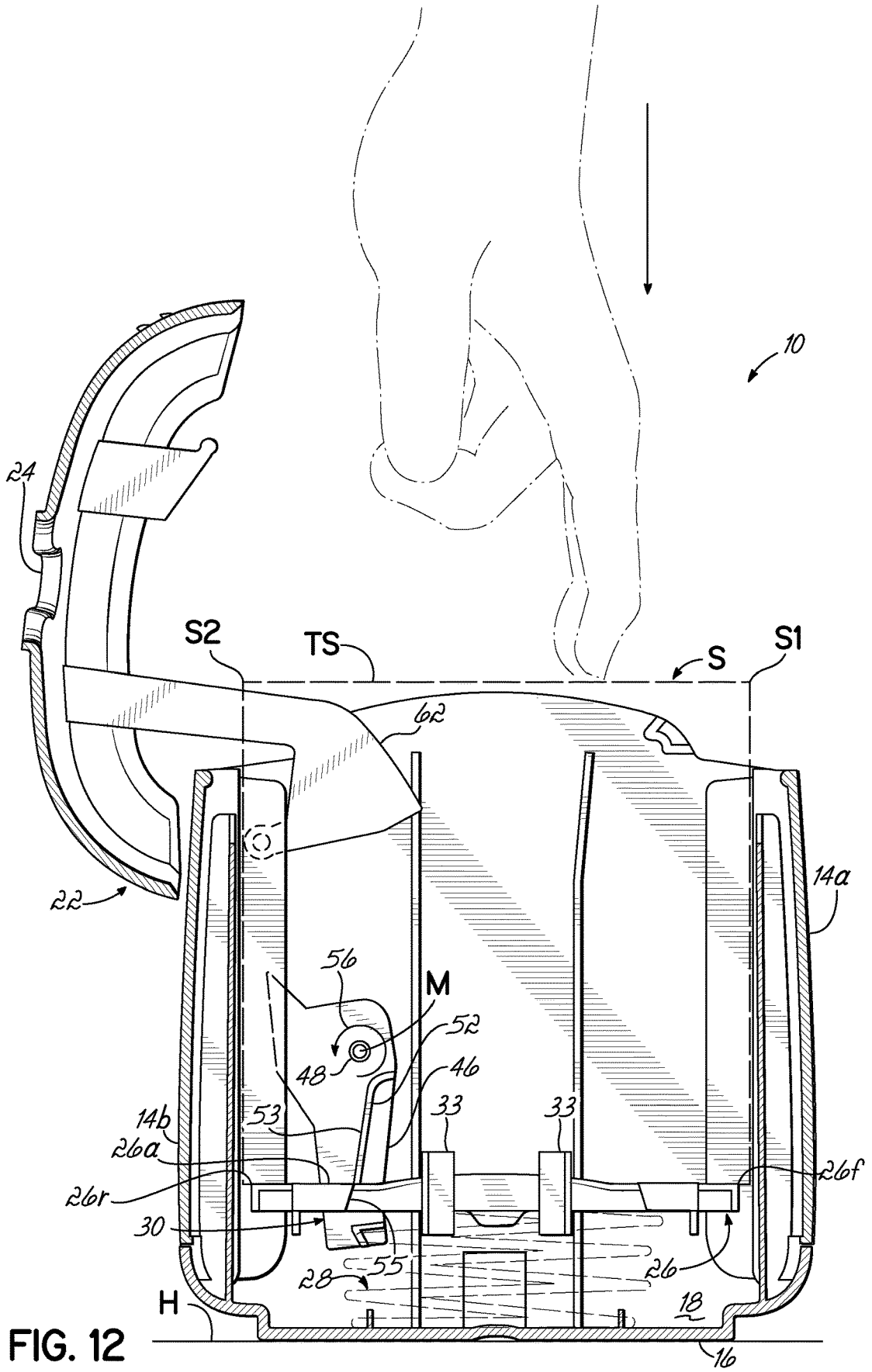
FIG. 12 is a view similar to FIGS. 3-5 and 8-11, schematically showing the stack in a position within the dispenser different from the positions of that stack in FIGS. 10 and 11.
Figure 13:
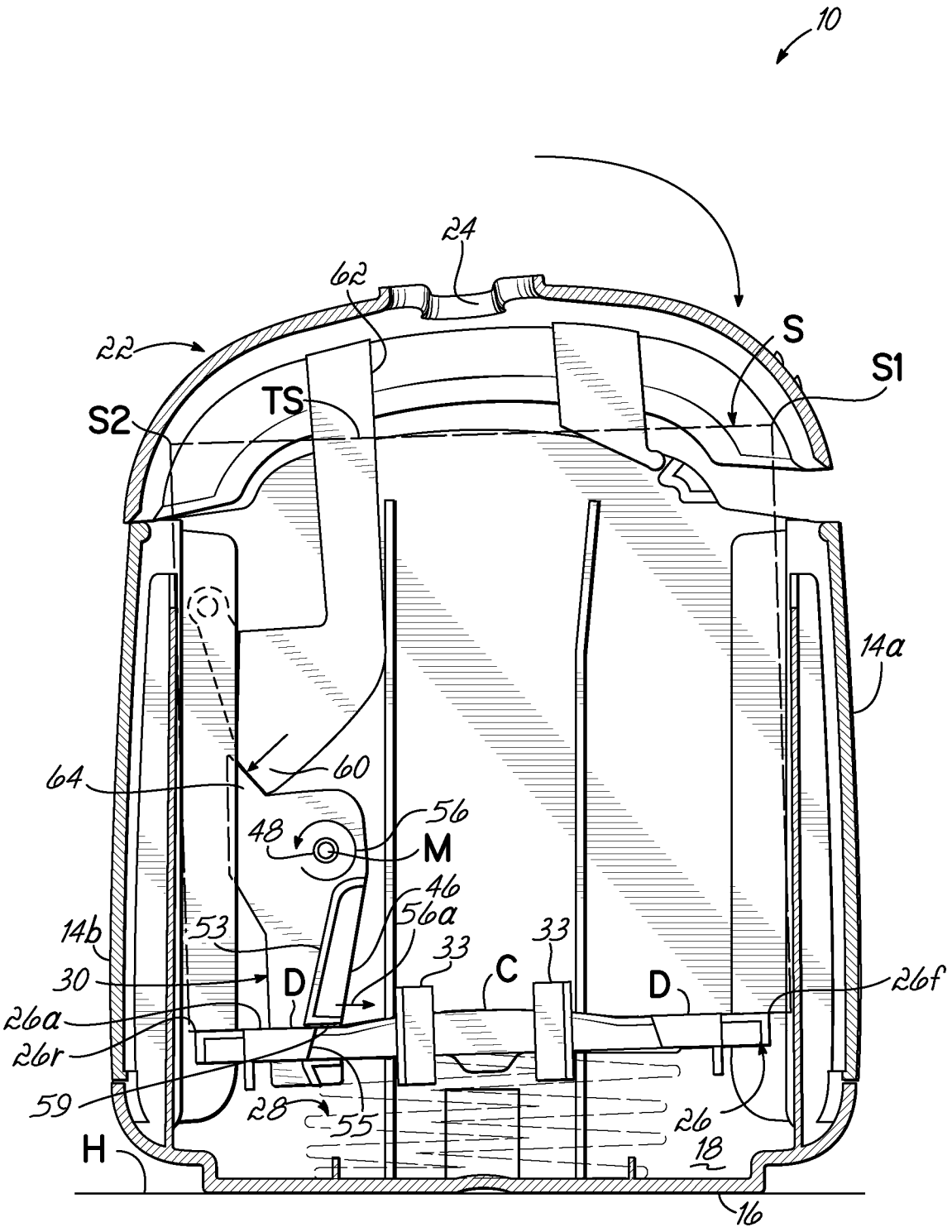
FIG. 13 is a view similar to FIGS. 3-5 and 8-12, showing closing of the lid of the dispenser with the stack (schematically shown) in the interior volume of that dispenser.

Lock 46 includes a ramp 52 having a ramp surface 53, that is engageable by a cooperating laterally protruding wing 55 of platen 26 as platen 26 moves downward, toward the bottom wall 16. As seen in FIG. 5A and sequentially in FIGS. 10-12, as the platen 26 moves downward by action of a user pushing down on the stack S supported by paper-engaging surface 26*a* of platen 26, wing 55 engages ramp surface 53 (FIG. 12). Continued downward movement of platen 26 causes pivoting movement of the bottom portion of lock 46 in a second direction 56, toward front wall 14*a*, opposing the urging force exerted by torsion spring 48 in the biased direction 50. Once the platen 26 reaches a position in which wing 55 no longer engages ramp surface 53, torsion spring 48 causes the bottom portion of lock 46 to snap back and pivotally move in the biased direction 50, toward the rear wall 14*b* of dispenser 10 (FIG. 13). At the same time, compression spring 28 pushes platen 26 upward, toward the top opening 20 of dispenser 10, with the force exerted by spring 28 pinning wing 55 against a bent end section 59 of ramp 52. The immobilized position of platen 26 at its locked position (i.e., position P, FIG. 5) is configured to orient the platen 26 obliquely, with a front edge 26*f* of paper-engaging surface 26*a* being higher than rear edge 26*r* of surface 26*a*. That oblique orientation or paper-engaging surface 26*a*, in turn, results in a similar orientation of the top surface TS of stack S, with the associated advantages described above.

Figure 14:
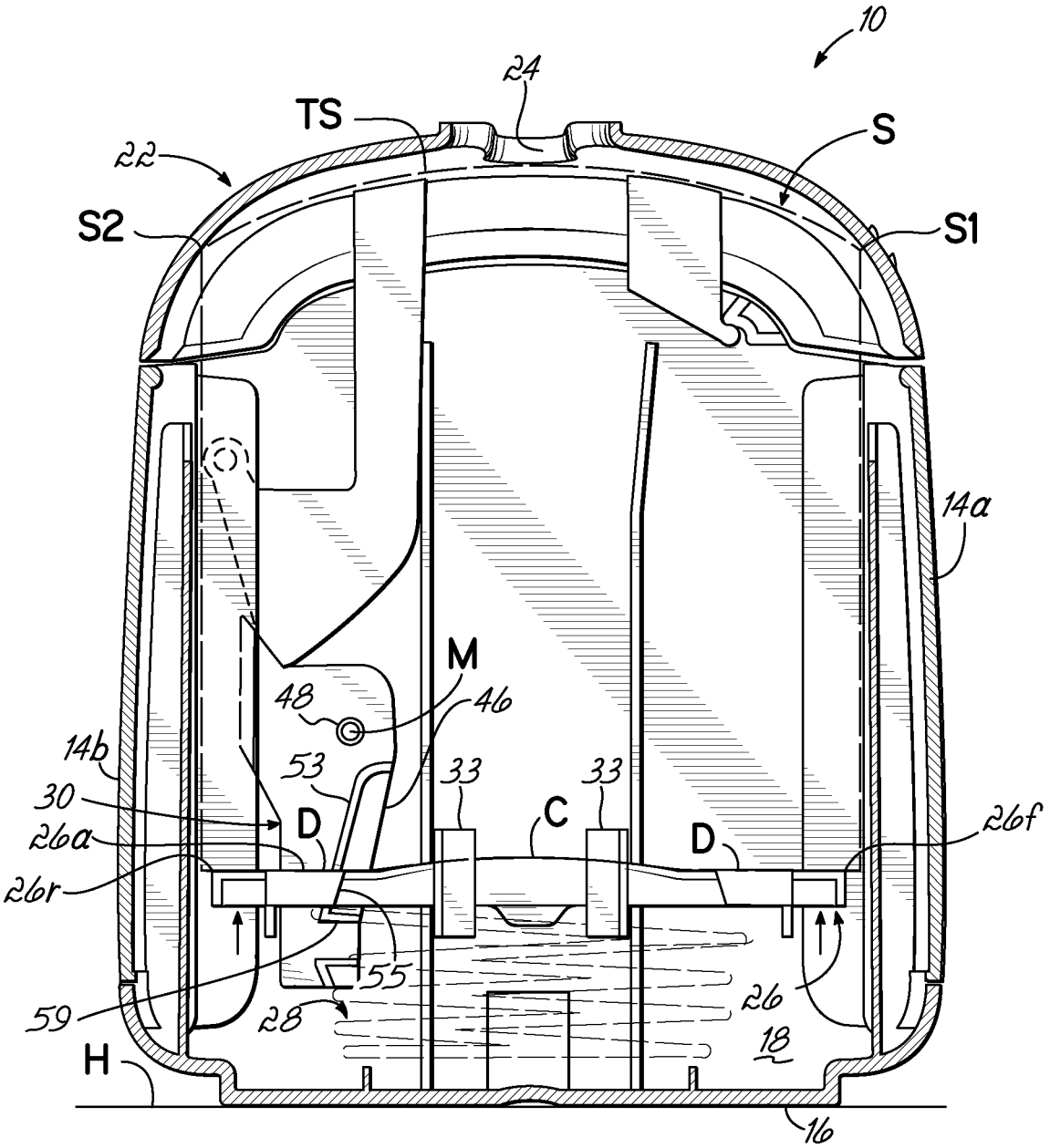
FIG. 14 is a view similar to FIGS. 3-5 and 8-13, with the lid of the dispenser in a closed position.

In operation, once the stack S has been loaded into interior volume 18 of dispenser 10, the person preparing the stack S for dispensing pivotally moves the lid 22 toward the closed position, as shown in FIG. 13. As that movement occurs, a distal end 60 of a support arm 62 of lid 22 engages a cooperating top end or cam 64 of lock 46, located above pivoting location M. With continued movement of lid 22 toward the closed position, the engagement of distal end 60 with cam 64 again causes pivoting movement of the bottom portion of lock 46 in the second direction 56, opposing the urging force exerted by torsion spring 48. Arrow 56*a* in FIG. 13 shows the direction of motion of the bottom portion of lock 46 associated with the pivoting movement of lock 46 in the second direction 56. Pivoting movement of the bottom portion of lock 46 in that second direction 56, in turn, results in disengagement of wing 55 of platen 26 from the bent end section 59 of ramp 52. That disengagement allows the platen 26 to pop toward top opening 20, by action of compression spring 28, which is effective to push the stack S against the underside of lid 22, and more specifically against dispensing aperture 24 (FIG. 14). FIGS. 6, 13, and 14 show paper-engaging surface 26*a* having a central section C that is bowed or curved (i.e., convex as seen from above), and two substantially planar end sections D. The bowed or curved and shape of central section C substantially matches the concave shape of the underside of lid 22. This feature provides a more uniform force exerted on the topmost napkin 11 in the stack by engagement with the underside of lid 22, as compared, for example, to a hypothetical entirely planar paper-engaging surface 26*a*. The relative uniform force exerted on the topmost napkin 11 enhances the dispensing experience, by requiring a relative low force to be exerted by the user in pulling such napkin toward the exterior of dispenser 10.

A contemplated method of loading and dispensing paper such as napkins 11 from a stack S of those napkins 11 accordingly includes unlocking the lid 22 from its closed position by exerting a force on the lid 22, relative to a remainder of dispenser 10, directed generally toward the rear wall 14*b* and lid axis 22*a*, and generally along a plane defined by top opening 20. That exerted force disengages a pair of locking lid tabs 66 of lid 22 from a pair of cooperating detents 70 located on the lateral walls 14*c*, 14*d* of dispenser 10, thereby allowing pivoting movement of lid 22 toward the open position of lid 22 (FIG. 4). This example method of unlocking lid 22 is advantageous in that same does not require the unnecessary bending of the sidewalls, which would ultimately likely lead to deformation or breaking of the dispenser. On the other hand, that method of unlocking requires the use of two hands (one hand to hold the lateral walls 14*c*, 14*d*, and one to push on lid 22 toward rear wall 14*b*), which may be undesirable in cases in which a one-hand opening operation is desired.

Figure 10:
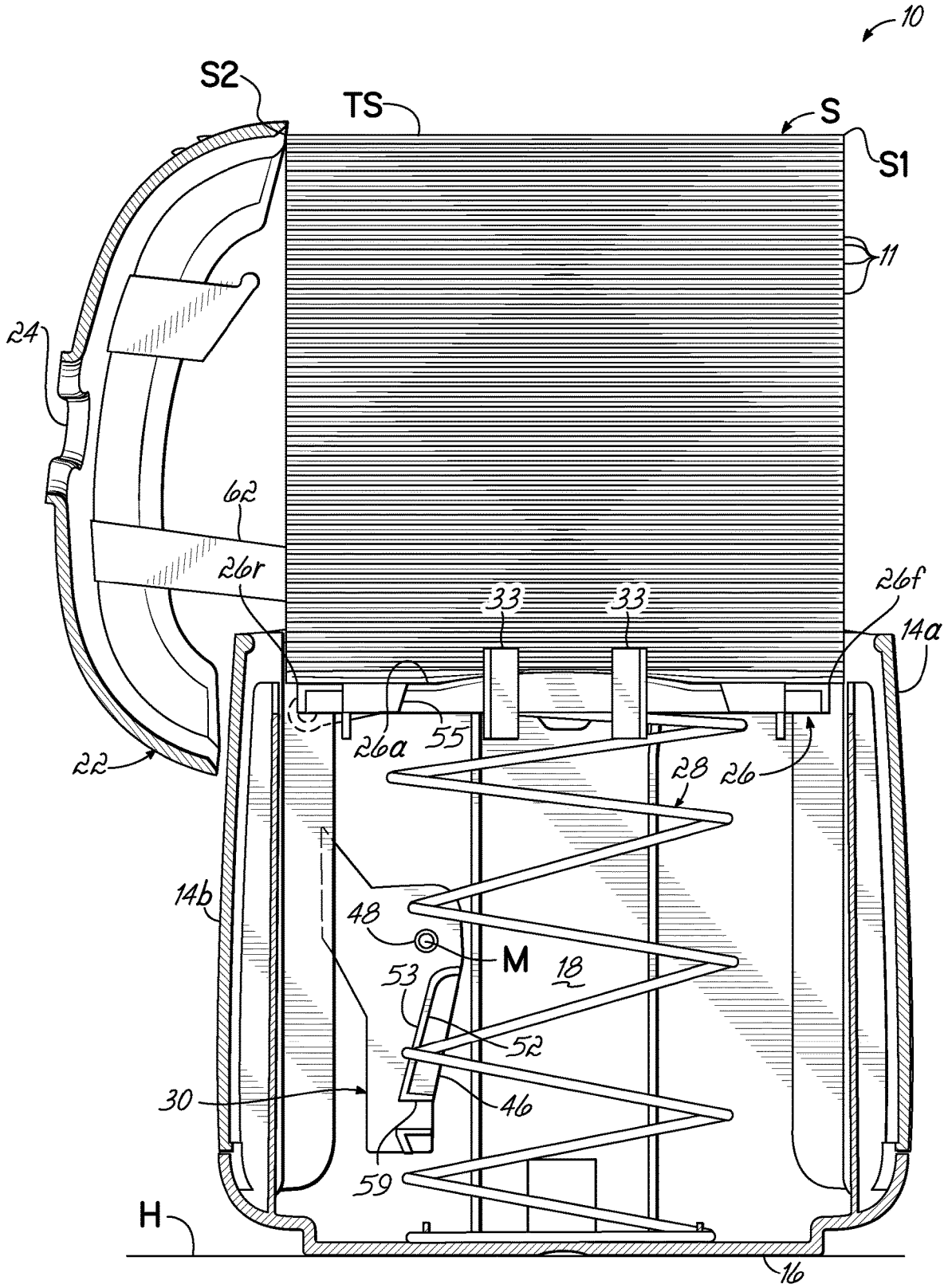
FIG. 10 is a view similar to FIGS. 3-5, 8, and 9, showing a stack of individual paper units being loaded into the interior volume of the dispenser.
Figure 11:
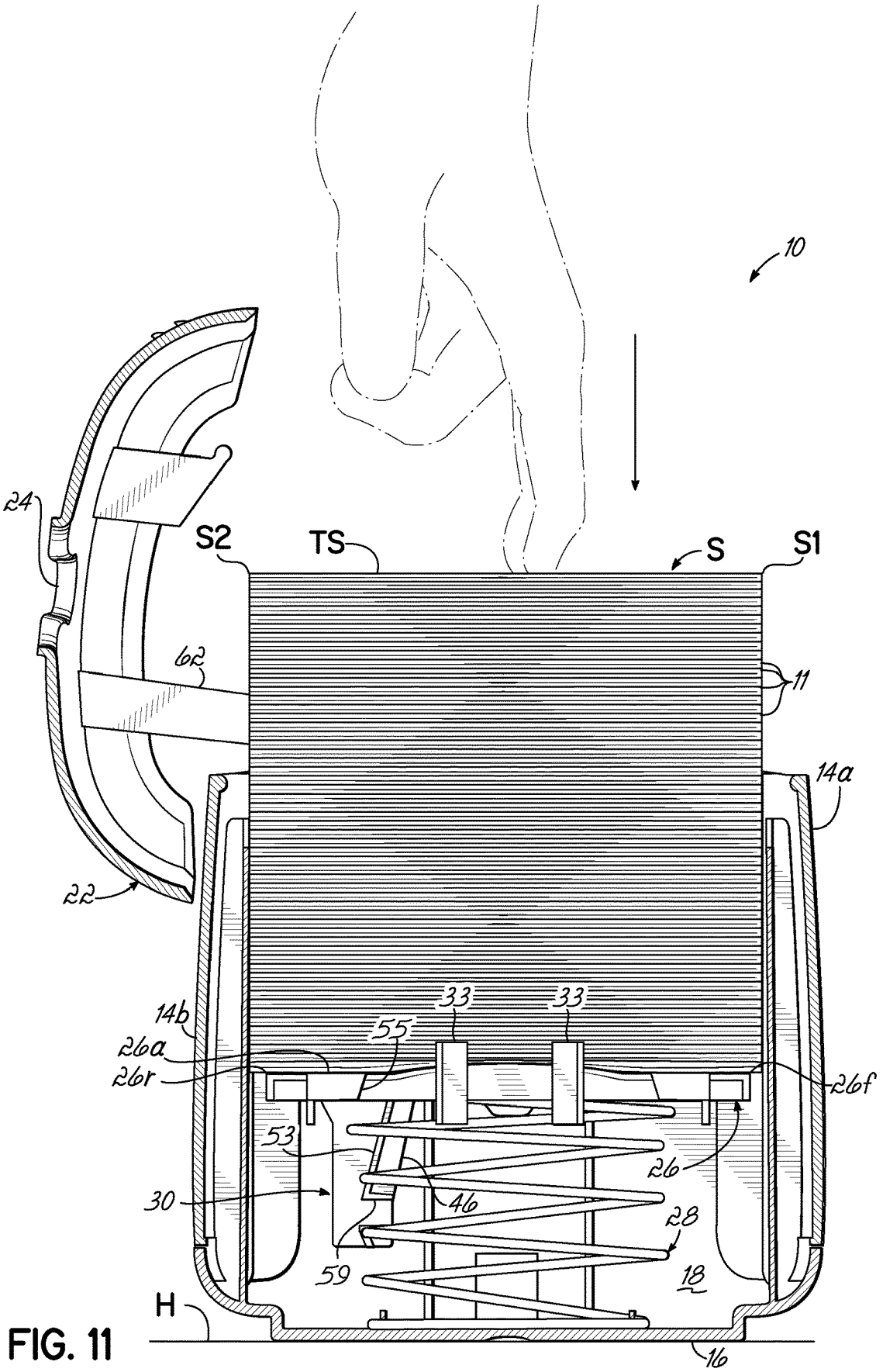
FIG. 11 is a view similar to FIGS. 3-5 and 8-10, showing the stack continuing to be loaded into the interior volume of the dispenser.

A contemplated loading operation includes unlocking lid 22 of dispenser 10 in the manner described above, opening the lid 22 by pivoting same about lid axis 22*a* toward the open position of the lid 22 (FIG. 4), and inserting the stack S of napkins 11 through top opening 20 into the interior volume 18 of the dispenser 10 (FIG. 10). The stack S is placed on the paper-engaging surface 26*a* of platen 26, for example using only one hand, and further so that the gripping tab 37 of the top-most napkin 11 of stack S, if present, is oriented to extend between front and rear walls 14*a*, 14*b* i.e., generally orthogonal to the length dimension of the dispensing aperture 24 when lid 22 is in its closed position (FIG. 7). The person loading the stack S then exerts a downward force on the stack S (FIGS. 11 and 12), thereby pushing the platen 26 in the same direction until the platen 26 is locked at position P (FIG. 5) by the locks 46 of locking mechanism 30. As stated above, in the locked position of platen 26, which corresponds to a locked condition of locking mechanism 30, the paper-engaging surface 26*a* of platen 26 attains an oblique orientation relative to the bottom wall 16 of dispenser 10 and also relative to the generally horizontal surface H on which dispenser 10 rests.

Upon cessation of the exertion of the downward force upon stack S, the person loading the stack S proceeds to pivot the lid 22 toward the closed position (FIG. 13), with that pivoting motion of lid 22 being effective to disengage locking mechanism 30 from the platen 26, thereby permitting platen 26 to pop up, by action of compression spring 28, toward top opening 20. Upon full closure of lid 22 (FIG. 14), the person loading the stack S inserts the thumb and forefinger through central section 40 of dispensing aperture 24. That person then pinches gripping tab 37—if present—and pulls the portion of the topmost napkin 11 defining gripping tab 37 through central section 40, toward the exterior (FIG. 8). Alternatively, before fully closing lid 22, the user may grip any portion of the topmost napkin 11 in stack S toward the underside of lid 22 and through central section 40, toward the exterior of dispenser 10, and then proceed to fully close lid 22. Once a portion of the topmost napkin 11 protrudes through dispensing aperture 24, the napkins 11 are ready for continuous dispensing.

From the above disclosure of the general principles of the present invention and the preceding detailed description of exemplifying embodiments, those skilled in the art will readily comprehend the various modifications to which this invention is susceptible. Accordingly, this invention is intended to be limited only by the scope of the following claims and equivalents thereof.

What is claimed is:

1. A method for loading a stack of interfolded paper units into a dispenser, the method comprising:

inserting the stack of interfolded paper units into an interior volume of the dispenser through a dispenser opening, wherein the stack includes a bottom surface and an oppositely disposed top surface, the bottom surface defining a footprint area of the stack, and wherein the dispenser includes a plurality of sidewalls and a lid connected to a pair of the plurality of sidewalls for selectively covering the dispenser opening, the lid having a dispensing aperture, the dispenser further including a movable platen having a paper-engaging surface and being urged upwardly toward the dispenser opening, a bottom wall disposed opposite the dispenser opening, and a rotatable spring-loaded lock selectively engageable with the platen and rotatably movable with respect to the platen, the spring-loaded lock being coupled to one of the plurality of sidewalls at a pivoting location so as to be rotatable about the pivoting location;

placing the stack on the paper-engaging surface of the platen in the interior volume of the dispenser;

exerting a downward force on the top surface of the stack to thereby push the platen downward, downward movement of the platen causing the rotatable spring-loaded lock to rotate about a lock axis in a first direction, the rotatable spring-loaded lock being biased to rotate in a second direction opposite the first direction;

ceasing exertion of the downward force when the platen has been engaged by the rotatable spring-loaded lock and has reached a locked position in which the paper-engaging surface has an oblique orientation relative to the bottom wall of the dispenser;

pivoting the lid about a lid axis from an open position toward a closed position of the lid to thereby cause rotation of the rotatable spring-loaded lock in the first direction, rotation of the spring-loaded lock in the first direction causing the rotatable spring-loaded lock to disengage from the platen; and extending a portion of an individual paper unit from the top surface of the stack through the dispensing aperture of the lid, to thereby dispense that individual paper unit.

2. The method of claim 1, wherein a ratio of the footprint area of the stack to the paper-engaging surface of the platen is in the range of about 0.7 to about 1.

3. The method of claim 2, wherein the ratio of the footprint area of the stack to the paper-engaging surface of the platen is in the range of about 0.85 to about 1.

4. The method of claim 3, wherein the ratio of the footprint area of the stack to the paper-engaging surface of the platen is in the range of about 0.95 to about 1.

5. The method of claim 1, wherein the paper-engaging surface of the platen has a first platen edge adjacent the lid axis, and a second platen edge opposite the first platen edge, the oblique orientation of the paper-engaging surface of the platen in the locked position of the platen being such that the first platen edge is closer than the second platen edge to the bottom wall of the dispenser.

6. The method of claim 1, wherein the top surface of the stack includes a first pair of surface edges parallel to one another, and a second pair of surface edges orthogonal to the first pair of surface edges, the first and second pairs of surface edges jointly defining a perimeter of the top surface of the stack, the top surface of the stack further including a linear gripping tab generally parallel to the first pair of surface edges and extending between the second pair of surface edges.

7. The method of claim 1, further comprising:

pushing the lid relative to a remainder of the dispenser, when the lid is in the closed position of the lid, in a direction toward the lid axis to thereby permit pivoting movement of the lid relative to the remainder of the dispenser.

8. The method of claim 1, wherein placing the stack on the paper-engaging surface of the platen in the interior volume of the dispenser includes placing a stack on the paper-engaging surface that has a height no greater than about 110 mm and a number of interfolded paper units no greater than about 120.

9. A method for loading a stack of interfolded paper units into a dispenser, the method comprising:

inserting the stack of interfolded paper units into an interior volume of the dispenser through a dispenser opening, wherein the stack includes a bottom surface and an oppositely disposed top surface, the bottom surface defining a footprint area of the stack, the top surface of the stack including a first pair of surface edges parallel to one another, and a second pair of surface edges orthogonal to the first pair of surface edges, the first and second pairs of surface edges jointly defining a perimeter of the top surface of the stack, the top surface of the stack further including a linear gripping tab generally parallel to the first pair of surface edges and extending between the second pair of surface edges, and wherein the dispenser includes a lid connected to a remainder of the dispenser for selectively covering the dispenser opening, the lid having a dispensing aperture including an elongated shape having a length dimension and a width dimension, the dispenser further including a movable platen having a paper-engaging surface and being urged upwardly toward the dispenser opening, a bottom wall disposed opposite the dispenser opening, and a lock selectively engageable with the platen;

placing the stack on the paper-engaging surface of the platen in the interior volume of the dispenser and orienting the stack such that the gripping tab is orthogonal to the length dimension of the dispensing aperture;

exerting a downward force on the top surface of the stack to thereby push the platen downward, downward movement of the platen being effective to pivot the lock about a lock axis in a first direction, the lock being biased to move in a second direction opposite the first direction;

ceasing exertion of the downward force when the platen has been engaged by the lock and has reached a locked position in which the paper-engaging surface has an oblique orientation relative to the bottom wall of the dispenser;

pivoting the lid about a lid axis from an open position toward a closed position of the lid to thereby cause pivoting of the lock in the first direction, pivoting of the lock in the first direction being effective to cause the lock to disengage from the platen; and extending a portion of an individual paper unit from the top surface of the stack through the dispensing aperture of the lid, to thereby dispense that individual paper unit.

10. The method of claim 9, wherein the dispensing aperture has a centrally located section and a pair of slotted sections on each side of the centrally located section, the width of the dispensing aperture in the centrally located section being greater than the width of the dispensing aperture in each of the slotted sections, the method including placing the stack on the paper-engaging surface of the platen such that the gripping tab is located within the centrally located section.

11. The method of claim 10, wherein each of the slotted sections has a width no greater than about 13 mm.

12. The method of claim 10, wherein the centrally located section has a width of less than about 30 mm.

13. The method of claim 10, wherein the centrally located section has a length no greater than about 40 mm.

* * * * *